US007198266B2

(12) United States Patent
Takahashi et al.

(10) Patent No.: US 7,198,266 B2
(45) Date of Patent: Apr. 3, 2007

(54) SHEET CASSETTE, SHEET FEEDING DEVICE AND IMAGE FORMING APPARATUS

(75) Inventors: Toshiaki Takahashi, Tokyo (JP); Kazuyuki Uchida, Yokohama (JP); Mitsuru Yamada, Tokyo (JP); Mamoru Yorimoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 364 days.

(21) Appl. No.: 10/812,953

(22) Filed: Mar. 31, 2004

(65) Prior Publication Data

US 2004/0247349 A1 Dec. 9, 2004

(30) Foreign Application Priority Data

Mar. 31, 2003 (JP) ..... 2003-094910
Jan. 30, 2004 (JP) ..... 2004-024804

(51) Int. Cl.
*B65H 1/00* (2006.01)

(52) U.S. Cl. ..... 271/171; 271/145

(58) Field of Classification Search ..... 271/145, 271/171, 162

See application file for complete search history.

(56) References Cited

U.S. PATENT DOCUMENTS 5,176,374 A 1/1993 Yamada
6,116,590 A * 9/2000 Yokoyama et al. ..... 271/171
6,308,027 B1 10/2001 Obu et al.
6,542,707 B2 4/2003 Muramatsu et al.
6,595,514 B2 7/2003 Takahashi
6,597,883 B2 7/2003 Muramatsu et al.
6,674,982 B2 1/2004 Saitoh et al.
6,697,584 B2 2/2004 Tsunoda et al.
6,725,003 B2 4/2004 Shimkai et al.
6,757,515 B2 6/2004 Ueda
6,869,071 B2 * 3/2005 Amamoto et al. ..... 271/145
6,985,265 B2 * 1/2006 Ito ..... 358/400
7,044,666 B2 * 5/2006 Takahashi et al. ..... 400/624
2004/0247349 A1 12/2004 Takahashi et al.

FOREIGN PATENT DOCUMENTS

JP 06048591 A * 2/1994
JP 06135574 A * 5/1994

OTHER PUBLICATIONS

U.S. Appl. No. 11/210,661, filed Aug. 25, 2005, Yamada et al.

* cited by examiner

*Primary Examiner*—Patrick Mackey
*Assistant Examiner*—Kaitlin Joerger
(74) *Attorney, Agent, or Firm*—Oblon, Spivak, McClelland, Maier & Neustadt, P.C.

(57) ABSTRACT

A sheet cassette includes a tray main body part, and a tray expansion/contraction part supported by the tray main body part and configured to slide relative to the tray main body part to a cassette expanded position where the sheet cassette is in an expanded state and a cassette contracted position where the sheet cassette is in a contracted state. The tray expansion/contraction part includes a rear end regulation member configured to be moved in a direction in which recording media stacked in the sheet cassette are fed to regulate rear ends of the recording media and a sliding guide part configured to support the rear end regulation member to freely slide and forming a moving path of the rear end regulation member.

28 Claims, 18 Drawing Sheets

SHEET CASSETTE, SHEET FEEDING DEVICE AND IMAGE FORMING APPARATUS

CROSS-REFERENCE TO RELATED APPLICATIONS

The present application claims priority to Japanese Patent Application Nos. 2003-094910 and 2004-024804 filed in the Japanese Patent Office on Mar. 31, 2003, and Jan. 30, 2004, respectively, and the entire contents of which are hereby incorporated by reference.

BACKGROUND OF THE INVENTION

1. Field of the Invention

The present invention relates to a sheet cassette in which recording media such as sheets are stacked, a sheet feeding device including the sheet cassette, and an image forming apparatus.

2. Discussion of the Background

In an image forming apparatus, such as a copier, a printer, a facsimile apparatus and a printing apparatus, an image formed by an image formation part thereof is transferred onto a recording medium such as a recording sheet conveyed from a sheet feeding device, and thereby a record output is obtained.

A sheet cassette in which recording media are stacked is installed in the sheet feeding device, and the sheet feeding device is configured to feed out the recording media in the cassette.

Some sheet cassettes are configured to accommodate recording media of a specific size. In this case, one sheet cassette is necessary for each desired size of recording media, so that the procurement and operating cost of the apparatus is increased. Further, when the image forming apparatus is configured such that one sheet cassette can be installed in the sheet feeding device, when use of a different size of recording media is desired a different sheet cassette must be installed, which is troublesome. Even when the image forming apparatus is configured such that a plurality of sheet cassettes can be installed in the sheet feeding device, often sheet cassettes must be exchanged. Furthermore, because a sheet cassette for recording media of a size that is used infrequently must be also procured, the procurement and operating cost of the apparatus is further increased.

Other sheet cassettes are configured such that recording media of different sizes can be accommodated. In this case, recording media of a desired size is accommodated in the cassette.

Japanese Patent Laid-open publication No. 9-110191 describes a sheet cassette capable of accommodating and feeding out recording media of a different size. The cassette includes a cassette main body and a sliding cassette arranged partially overlapped with the cassette main body to slide relative to the cassette main body, and can be expanded and contracted in the longitudinal direction of recording media by sliding the sliding cassette relative to the cassette main body based on sizes of recording media.

The sheet cassette includes side fences and an end fence that are movable to contact side edges and rear end edges of recording media stacked in the cassette, respectively, to regulate the positions of the side edges and the rear end edges of recording media so that skewing and returning of the recording media occurring when the recording media are fed out of the cassette can be prevented. The end fence is movable to a position corresponding to rear ends of recording media of a certain size. Therefore, when recording media of a smaller size is accommodated in the cassette in the expanded state, depending on the size of the recording media, it occurs that the end fence cannot be moved to the position corresponding to the rear ends of the recording media. In this case, the end fence cannot regulate rear ends of the recording media when the recording media are fed, so that inferior feeding out of recording media may occur.

When a sheet cassette is formed in a box shape in which the upper surface is opened as in the sheet cassette of JP No. 9-110191, it may be conceivable that the cassette is molded using resin. When such a sheet cassette is in the expanded state, torsional deformation easily occurs in the cassette. In particular, when a slit for inserting a guide is formed at a part of the base plate of the cassette as in the sheet cassette of JP No. 9-110191, the rigidity of the cassette is excessively decreased at that part, so that torsional deformation in the base plate of the cassette may not be avoided. If torsional deformation occurs in the base plate of a sheet cassette, the contact condition between the uppermost sheet of recording media stacked in the cassette and a feeding roller arranged to feed the uppermost sheet of the recording media is changed depending upon the size of the recording media stacked in the cassette, so that depending upon the size of recording media stacked in the cassette, inferior feeding of the recording media may occur.

SUMMARY OF THE INVENTION

The present invention has been made in view of the above-described and other problems and addresses the above-described and other problems.

Preferred embodiments of the present invention provide a novel sheet cassette capable of expanding and contracting according to sizes of recording media to be accommodated in the cassette, that enables accommodating and satisfactorily feeding out recording media of a smaller size which cannot be satisfactorily fed out otherwise in the expanded state of the cassette and that avoids inferior feeding out of recording media accommodated in the cassette by preventing weakness in mechanical strength of the cassette. The preferred embodiments of the present invention further provide a novel sheet feeding device including the sheet cassette and an image forming apparatus including the sheet cassette.

According to a preferred embodiment of the present invention, a sheet cassette includes a tray main body part, and a tray expansion/contraction part supported by the tray main body part and configured to slide relative to the tray main body part to a cassette expanded position where the sheet cassette is in an expanded state and a cassette contracted position where the sheet cassette is in a contracted state. The tray expansion/contraction part includes a rear end regulation member configured to be moved in a direction in which recording media stacked in the sheet cassette are fed to regulate rear ends of the recording media and a sliding guide part configured to support the rear end regulation member to freely slide and forming a moving path of the rear end regulation member.

The sheet cassette may further include an auxiliary member that is configured to be attached, when the tray expansion/contraction part is in the cassette expanded position, to the sliding guide part of the tray expansion/contraction part to extend a length of the moving path of the rear end regulation member of the tray expansion/contraction part between the tray expansion/contraction part and the tray main body part and is configured to be detached from the sliding guide part of the tray expansion/contraction part when the tray expansion/contraction part is in the cassette contracted position.

Thus, when the sheet cassette is used in the expanded state with the auxiliary member attached to the sliding guide part of the tray expansion/contraction part, a length of the moving path of the end regulation member of the tray expansion/contraction part is extended by the attached auxiliary member so that the end regulation member can be moved up to the position, to which, in the contracted state of the sheet cassette, the rear end regulation member can be moved to regulate rear ends of recording media of a smaller size. Accordingly, even when recording media of a smaller size, which, when accommodated in the expanded state of the sheet cassette used in the state in which the sheet cassette can be expanded and contracted, cannot be regulated at rear ends thereof by the rear end regulation member, are accommodated in the sheet cassette, the rear end regulation member can be moved to the position of regulating the recording media at the rear ends thereof. That is, a sheet cassette that is capable of accommodating recording media of a larger size and that is yet capable of regulating recording media of a smaller size at rear ends thereof is provided without incorporating any change in the tray expansion/contraction part to allow the rear end regulation member to move to the position of regulating the recording media of a smaller size and without changing a mold tool used in molding the sheet cassette and thereby avoiding cost increase.

Furthermore, the auxiliary member is configured, when the sheet cassette is in the expanded state, to connect, at one side end thereof, with an end of the sliding guide part of the tray expansion/contraction part in the direction in which the recording media are fed and to contact the tray main body part at the other side end thereof.

Thereby, when the sheet cassette is in the expanded state with the auxiliary member attached to the sliding guide part of the tray expansion/contraction part, the tray expansion/contraction part is regulated from being inadvertently moved in the direction in which the sheet cassette is contracted, to prevent inadvertent contraction of the sheet.

Still further, a fall-off prevention member may be provided to an end part of the sliding guide part of the tray expansion/contraction part at the side of the tray main body part and configured to prevent the rear end regulation member from falling off the sliding guide part. The fall-off prevention member may be disposed across the sliding guide part of the tray expansion/contraction part such that ends thereof engage the sliding guide part.

The fall-off prevention member sets the moving boundary position in the moving path of the rear end regulation member formed by the sliding guide part of the tray expansion/contraction part and can prevent the rear end regulation member from being disengaged from the sliding guide part of the tray expansion/contraction part. Further, because the fall-off prevention member is disposed across the sliding guide part and the ends thereof engage the sliding guide part, the fall-off prevention member holds the sliding guide part of the tray expansion/contraction part without distortion, to prevent blocking movement of the rear end regulation member by torsional deformation in the sliding guide part. Thereby, the contact condition of the rear end regulation member with the rear ends of recording media stacked in the sheet cassette is appropriately set, so that returning of the recording media when the recording media are fed out can be prevented and thereby satisfactory feeding out of the recording media from the sheet cassette can be provided.

Furthermore, a reinforcing member may be provided to a backside surface of the tray expansion/contraction part. The reinforcing member may extend across the sliding guide part of the tray expansion/contraction part and be integrated with the tray expansion/contraction part at both ends thereof in a direction in which the reinforcing member is extended and configured to prevent the tray expansion/contraction part from extending in a direction orthogonal to the direction in which the tray expansion/contraction part slides.

Thereby, even when a slit is formed in the tray expansion/contraction part such that the slit is opened at an end of the tray expansion/contraction part, the tray expansion/contraction part can be prevented from extending outwardly (in the direction orthogonal to the direction in which the tray expansion/contraction part slides) at the end part thereof by the reinforcing member, so that distortion of the tray expansion/contraction part thereof can be prevented, and prevention of falling off of the rear end regulation member and smooth movement of the rear end regulation member are provided.

Further, the tray main body part may include holding parts configured to hold the tray expansion/contraction part at the cassette expanded position and the cassette contracted position, and an indication part configured to differentiate a state in which the tray expansion/contraction part is held by the tray main body part from a state in which the tray expansion/contraction part is released from being held by the tray main body part. The tray expansion/contraction part may include engaging members, and the holding parts of the tray main body part may include locking parts configured to engage with and disengage from the engaging members of the tray expansion/contraction part, and the indication part may be configured to differentiate a state in which the tray expansion/contraction part is held by the tray main body part from a state in which the tray expansion/contraction part is released from being held by the tray main body part according to engaging states of the engaging members of the tray expansion/contraction part and the locking parts of the tray main body part.

Thus, the tray expansion/contraction part can be set in the cassette expanded position and the cassette contracted position according to the intention of the operator and the state of the tray expansion/contraction part is indicated by the indication part, so that it can be prevented that the tray expansion/contraction part is inadvertently moved by the operator.

According to another preferred embodiment of the present invention, a sheet feeding device including the above-described sheet cassette is provided.

According to still another preferred embodiment of the present invention, an image forming apparatus including the above-described sheet cassette is provided.

In the sheet feeding device and the image forming apparatus, by including the sheet cassette described above, the sheet cassette needs not be changed according to sizes of recording media, and further, inferior feeding out of recording media can be prevented regardless of the size of recording media accommodated in the sheet cassette.

BRIEF DESCRIPTION OF THE DRAWINGS

A more complete appreciation and understanding of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
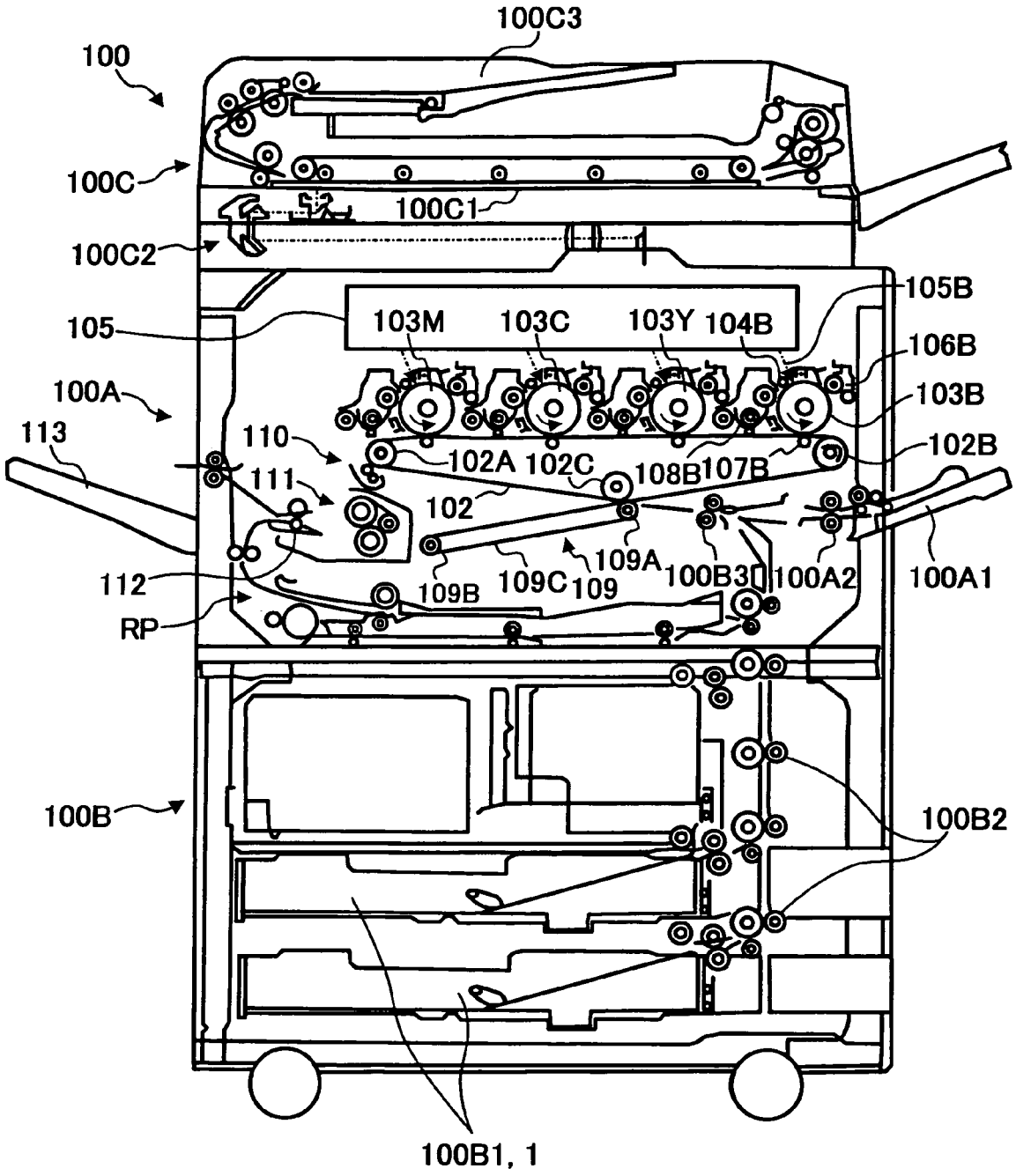
FIG. 1 is a diagram illustrating an image forming apparatus in which a sheet cassette according to a preferred embodiment of the present invention is used.

Referring now to the drawings, wherein like reference numerals designate identical or corresponding parts throughout the several views, preferred embodiments of the present invention are described.

FIG. 1 illustrates an image forming apparatus in which a sheet cassette according to a preferred embodiment of the present invention is used. The illustrated image forming apparatus is a color printer of a tandem system structure, in which a plurality of photoconductors serving as latent image bearing members on which images of individual colors corresponding to separated colors can be formed are arranged. Toner images of individual colors formed on respective photoconductors are transferred onto an intermediary transfer member while being superimposed on top of another on the intermediary transfer member and superimposed images are transferred onto a recording sheet, and thereby a full color image is obtained on the recording sheet. The sheet cassette can also be used in color copiers, facsimile apparatuses, and printing apparatuses.

As illustrated in FIG. 1, in a color printer 100, an image formation part 100A is arranged in the middle part thereof in the vertical direction, a sheet feeding part 100B is arranged below the image formation part 100A, and an original document scan part 100C including an original document plate 100C1 is arranged above the image formation part 100A.

The image formation part 100A includes an intermediary transfer belt 102 having a surface extending in the horizontal direction, and image formation units for forming images of individual colors in the relation of complementary colors of separated colors are provided above the intermediary transfer belt 102.

The image formation units of the image formation part 100A includes photoconductors 103B, 103Y, 103C and 103M on which images developed with toner of individual colors (yellow, magenta, cyan and black) can be formed, respectively, along the surface of the intermediary transfer belt 102. Herein below, when a description applies to the photoconductors 103B, 103Y, 103C and 103M, the description will be made using a photoconductor denoted by the reference symbol 103.

The photoconductors 103B, 103Y, 103C and 103M include drums, which are rotatable in the same direction (a counterclockwise direction in FIG. 1). A charge device 104, a writing device 105, a development device 106, a primary transfer device 107, and a cleaning device 108 are arranged around each of the photoconductor 103B, 103Y, 103C and 103M to perform respective image formation processes. In FIG. 1, for convenience sake, devices arranged around the photoconductor 103B are denoted by respective reference symbols annexed with "B".

The intermediary transfer belt 102 corresponds to a primary transfer part onto which visual images are sequentially transferred from the image formation units having the photoconductors 103B, 103Y, 103C and 103M. The intermediary transfer belt 102 is spanned around and surrounds a plurality of rollers 102A, 102B and 102C, and is rotated in the direction in which the photoconductors 103B, 103Y, 103C and 103M are rotated at positions where the intermediary transfer belt 102 faces the photoconductors 103B, 103Y, 103C and 103M. The rollers 102A and 102B form the surface of the intermediary transfer belt 102 facing the photoconductors 103B, 103Y, 103C and 103M, and the roller 102C opposes a secondary transfer device 109 while sandwiching the intermediary transfer belt 102 with the secondary transfer device 109, such that the intermediate transfer belt 102 is disposed between the roller 102C and the transfer device 109. A cleaning device 110 cleans the surface of the intermediary transfer belt 102.

The secondary transfer device 109 includes a transfer belt 109C spanned around and surrounding a charge drive roller 109A and a driven roller 109B, and is moved in the same direction as the intermediary transfer belt 102 moves at a secondary transfer position where the charge drive roller 109A faces the roller 102C. By charging the transfer belt 109C with the charge drive roller 109A, a recording medium such as a recording sheet is electrostatically retained on the transfer belt 109C, and thereby the recording medium is conveyed by the transfer belt 109C. Superimposed images of individual colors or an image of a single color on the intermediary transfer belt 102 is transferred at the secondary transfer position onto the recording medium being conveyed by the transfer belt 109C. The recording medium is conveyed to the secondary transfer position from the sheet feeding part 100B.

The sheet feeding part 100B serving as a sheet feeding device of the present invention includes a plurality of sheet cassettes 100B1 in which recording media are accommodated, respectively, a plurality of rollers 100B2 arranged along a conveying path of recording media fed out from the sheet cassettes 100B1, and a pair of registration rollers 100B3 arranged at the upstream side of the secondary transfer position in the direction in which the recording media are conveyed. A recording medium fed out from either of the sheet cassettes 100B1 is conveyed through the conveying path toward the secondary transfer position. In this embodiment, a manual sheet feeding tray 100A1 and a pair of feeding rollers 100A2 are provided so that a recording medium that is not accommodated in the cassettes 100B1 is manually inserted and conveyed toward the secondary transfer position. The manual sheet feeding tray 100A1 is formed by a part of the wall of the image formation part 100A that is configured to be inclined relative to the wall of the image formation part 100A.

A recording media conveying path from the manual sheet feeding tray 100A1 joins with the conveying path from the sheet cassettes 100B1 toward the registration rollers 100B3 at a midway point thereof so that a timing of conveying a recording medium conveyed through either of the conveying paths toward the secondary transfer position can be set by the registration rollers 100B3.

The writing device 105 controls writing light 105B according to image information obtained as a result of scanning an original document placed on the original document plate 100C1 of the original document scan part 100C or image information outputted from a computer (not shown), and forms latent images corresponding the image information on the photoconductors 103B, 103Y, 103C and 103M.

The original document scan part 100C includes a scanner 100C2 to expose and scan the original document placed on the original document plate 100C1. Further, an automatic original document feeding device 100C3 is arranged at the upper surface of the original document plate 100C1. The automatic original document feeding device 100C3 includes a mechanism to reverse an original document fed onto the original document plate 100C1 so that both surfaces of the original document can be scanned.

A latent image formed on the photoconductor 103 (each of the photoconductors denoted with the reference symbols 103B, 103Y, 103C and 103M in FIG. 1) is developed with toner into a visual toner image by the corresponding development device 106 (e.g., 106B in FIG. 1) and is then transferred onto the intermediary transfer belt 102. Toner images of individual colors transferred onto the intermediary transfer belt 102 while being superimposed on top of another on the intermediary transfer belt 102 are then transferred onto a recording medium by the secondary transfer device 109, and thereby a full color image is formed on the recording medium.

The full color image on the recording medium is then fixed onto the recording medium by a fixing device 111. The fixing device 111 includes a belt fixing mechanism having a fixing belt heated by a heating roller and a pressure roller facing and contacting the fixing belt (not shown). The belt fixing mechanism can increase a heating area relative to a recording medium as compared with other fixing mechanisms using rollers by providing a contact area, i.e., a nip area, between the fixing belt and the pressure roller.

The recording medium passed the fixing device 111 is selectively conveyed to either of a conveying path toward a discharge tray 113 and a reverse conveying path RP by a conveying path switch claw 112 arranged downstream of the fixing device 111 in the direction in which the recording medium is conveyed.

In the color printer 100 configured as described above, a latent image is formed on the photoconductor 103 that has been uniformly charged by the charging device 104 by scanning an original document placed on the original document plate 100C1 with the scanner 100C2 or by outputting image information from a computer, the latent image is developed into a visual toner image by the development device 106, and the toner image is transferred onto the intermediary transfer belt 102 by the primary transfer device 107.

When forming a single color image with the color printer 100, a toner image transferred onto the intermediary transfer belt 102 is transferred onto a recording medium fed from the sheet feeding part 100B. When forming a full color image with the color printer 100, toner images of individual colors are transferred onto the intermediary transfer belt 102 while being superimposed on top of another on the intermediary transfer belt 102, and then superimposed images of individual colors are transferred onto a recording medium, and thereby the full color image is formed on the recording medium. The single or full color image is fixed onto the recording medium by the fixing device 111, and the recording medium is conveyed toward the discharge tray 113 or reversed to be conveyed again toward the registration rollers 100B3.

Figure 2:
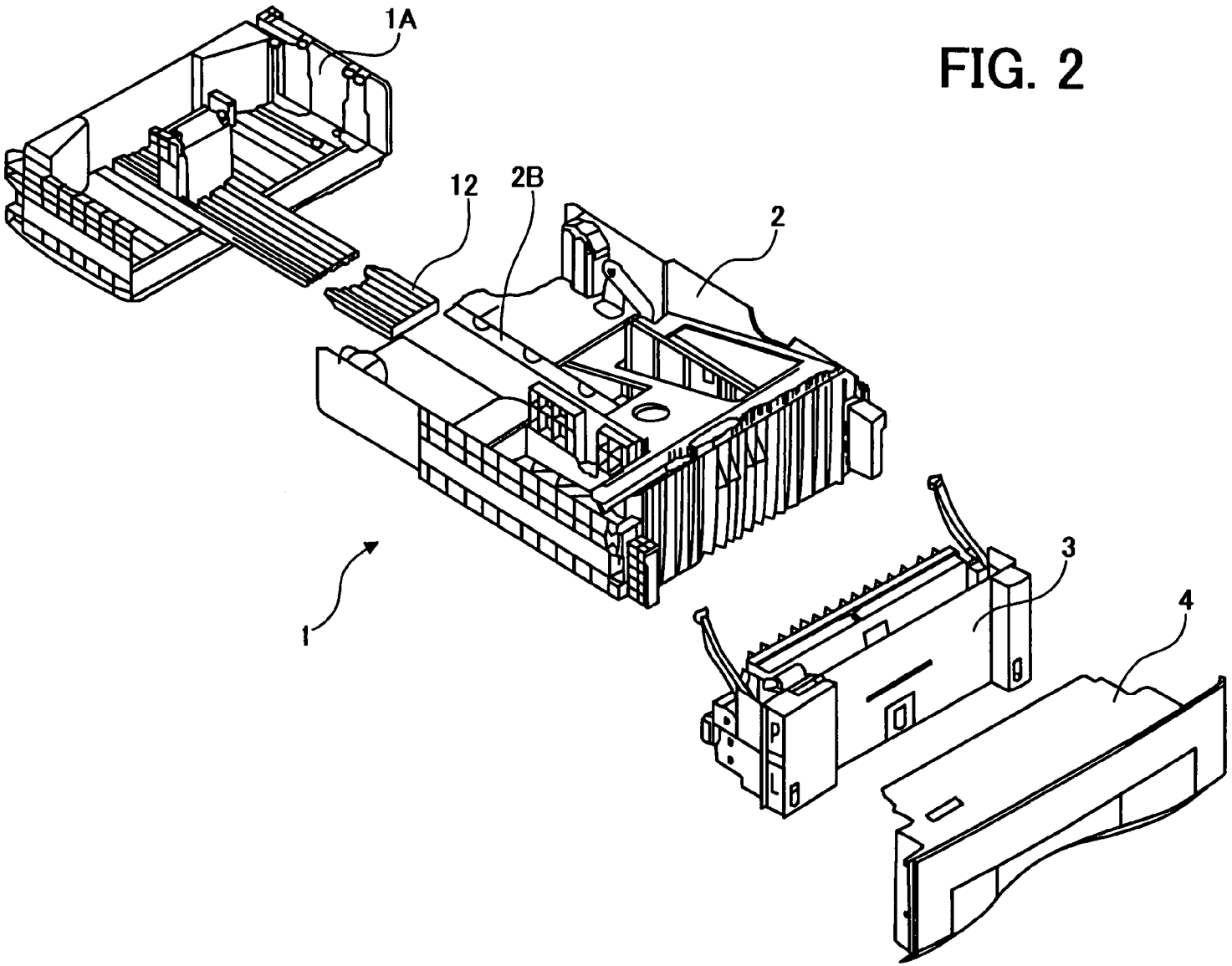
FIG. 2 is a diagram illustrating the sheet cassette.
Figure 3A:
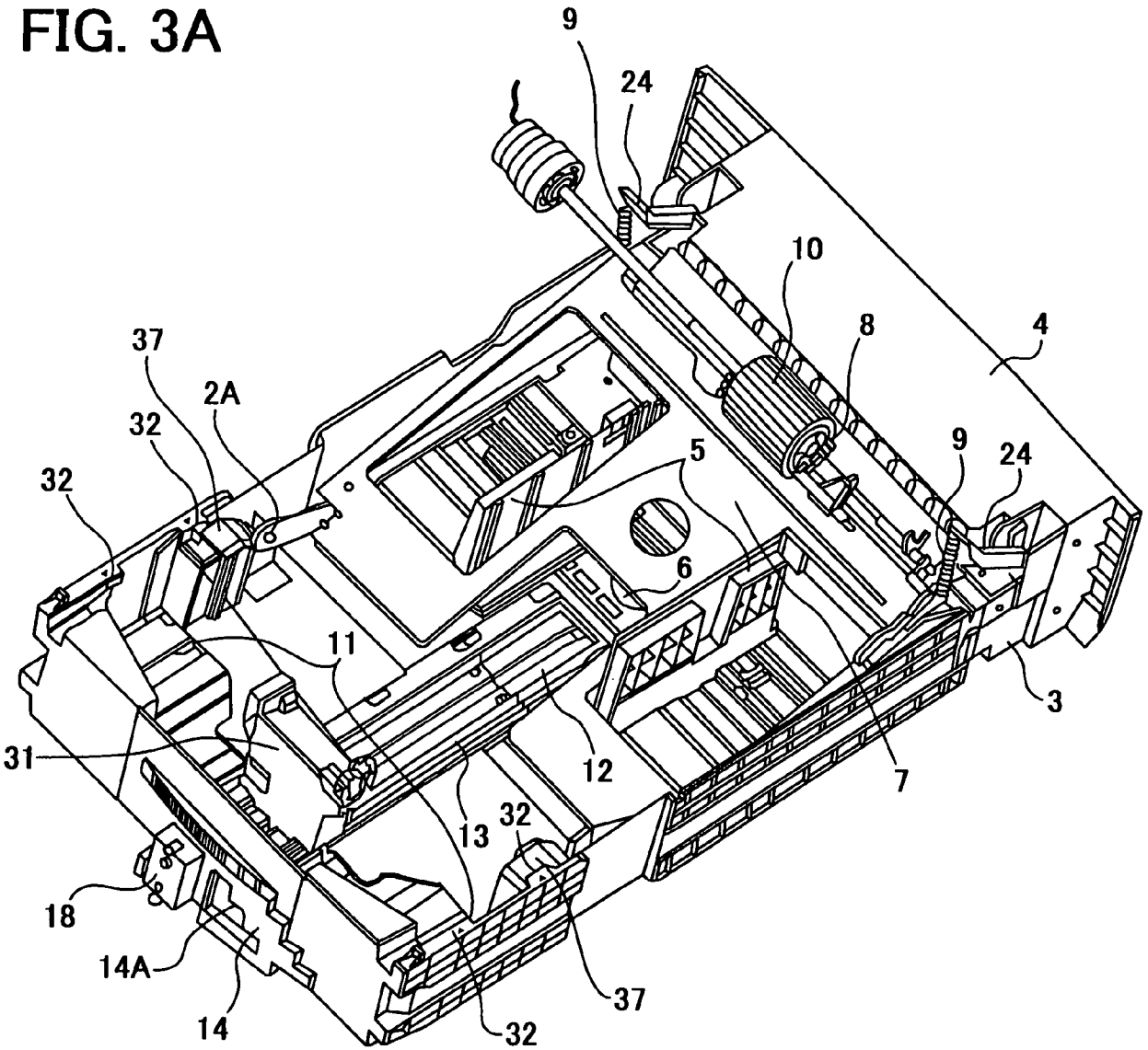
FIG. 3A is a perspective view of the sheet cassette.

FIG. 2 and FIG. 3A illustrate a sheet cassette 1 installed in the sheet feeding part 100B1. As illustrated in FIG. 2, the sheet cassette 1 includes a tray expansion/contraction part 1A, a tray main body part 2, a conveying guide part 3, and an outer cover part 4. FIG. 3A illustrates the sheet cassette 1 expanded to a capacity size using a mechanism described later. The sheet cassette 1 in this state is not expanded and contracted according to sizes of recording media.

The tray main body part 2 includes, as illustrated in FIG. 3A, a pair of side fences 5, a pinion gear 6, a stacking plate 7, and a friction pad 8 serving as a separating device.

The side fences 5 include an integrated rack, and move in relative directions, respectively, via the pinion gear 6 engaged with the rack. The side fences 5 slidably move to the positions corresponding to side edges of recording media stacked in the cassette 1 to regulate positions of the side edges in the widthwise direction of the recording media, and thereby the recording media stacked in the cassette 1 are prevented from being skewed when the recording media are fed out from the cassette 1.

Referring to FIG. 3A, the stacking plate 7 engages with a support part 2A formed in the tray main body part 2 and is configured such that an end part thereof opposite the support part 2A can be raised with springs 9. By raising the end part of the stacking plate 7, the recording media stacked in the cassette 1 are raised and pressed to contact a feeding roller 10 arranged in the sheet feeding part 100B of the color printer 100.

The friction pad 8 uses a friction member such as rubber or cork, and is attached to the stacking plate 7.

Referring to FIG. 2, the tray expansion/contraction part 1A is a member to be attached to the tray main body part 2 to slide relative to the tray main body part 2 with a portion thereof inserted into the tray main body part 2. By slidably moving the tray expansion/contraction part 1A relative to the tray main body part 2 to an expanded position where the sheet cassette 1 is expanded and a contracted position where the sheet cassette 1 is contracted, the sheet cassette 1 is configured in the expanded state and the contracted state. Disengagement prevention claws 11 (FIG. 3A) provided to outer side surfaces of the bottom face of the tray expansion/contraction part 1A are engaged with grooves formed in the bottom part of the tray main body part 2, and thereby the tray expansion/contraction part 1A can be prevented from being disengaged from the tray main body part 2 when the tray expansion/contraction part 1A is in the expanded position.

Figure 3B:
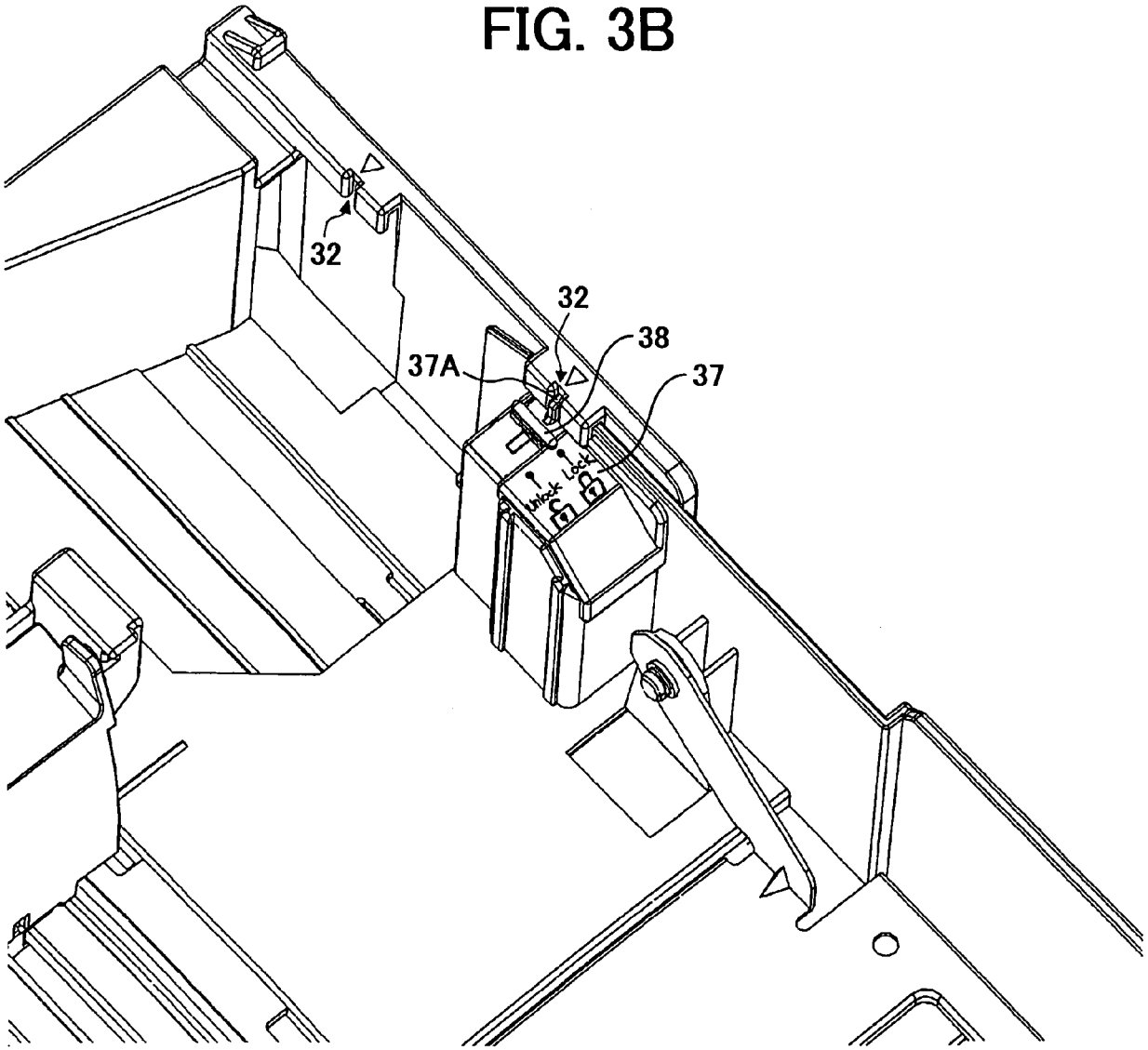
FIG. 3B is an enlarged diagram of a portion of the cassette for explaining a construction of a locking part of the cassette.

Referring to FIGS. 3A and 3B, the tray expansion/contraction part 1A is held by the tray main body part 2 at the expanded position and the contracted position. Locking parts 37 are provided to internal surfaces of end parts of the tray main body part 2 at the side of the tray expansion/contraction part 1A, and groove parts 32 are provided to internal surfaces of wall parts of the tray expansion/contraction part 1A at positions corresponding to the locking parts 37 of the tray main body part 2 when the tray expansion/contraction part 1A is in the expanded position and the contracted position. Further, protruding members 37A movable toward the groove parts 32 of the tray expansion/contraction part 1A are provided, though the details are not shown, to the locking parts 37. The protruding members 37A provided to the locking parts 37 of the tray main body part 2 are inserted into the groove parts 32 at the side of the tray expansion/contraction part 1A, and thereby the tray expansion/contraction part 1A is held by the tray main body part 2 at the expanded position and the contracted position. Slits (not shown) are provided to wall parts of the tray main body part 2 so that the protruding members provided to the locking parts 37 can move toward the groove parts 32 at the side of the tray expansion/contraction part 1A, respectively.

The protruding members 37A provided to the locking parts 37 of the tray main body part 2 are members that are manipulated by an operator. Therefore, marks indicating the hold and hold release positions of the protruding members 37A are provided on surfaces of the locking parts 37 at positions corresponding to the positions of indicators 38 integrated with the protruding members 37A when the protruding members 37A have moved toward and retreated from the groove parts 32, respectively. The operator can determine the state of the tray expansion/contraction part 1A by identifying the marks on the surfaces of the locking parts 37 pointed by the indicators 38. Thereby, inadvertent movement of the tray expansion/contraction part 1A by the operator can be prevented.

When the cassette 1 is used in the state in which the cassette 1 is not expanded and contracted by the operator, the marks indicating the hold and hold release positions of the protruding members 37A on the surfaces of the locking parts 37 may be covered by arranging a blinder member over the marks.

Figure 4:
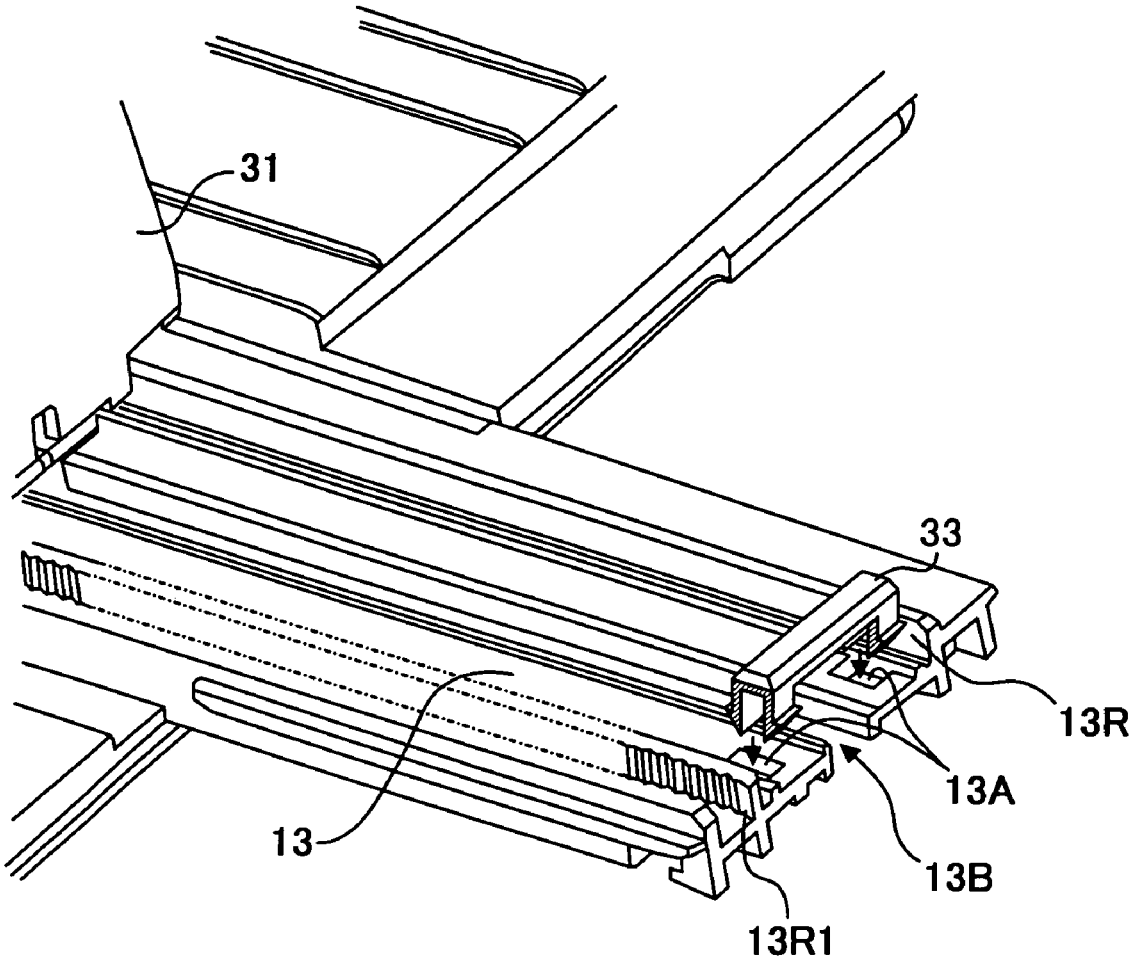
FIG. 4 is a diagram illustrating an illustration of a fall-off prevention member to an end fence guide part of the sheet cassette.

The tray expansion/contraction part 1A includes, as illustrated in FIG. 3A, an end fence guide part 13 at the center thereof in the widthwise direction of recording media stacked in the sheet cassette 1. The end fence guide part 13 extends beyond an edge of the tray expansion/contraction part 1A in the direction in which recording media stacked in the cassette 1 are fed. An end fence 31 functioning as a rear end regulation member of the present invention is engaged, at the bottom face thereof, with the end fence guide part 13 of the tray expansion/contraction part 1A such that the end fence 31 can slidably move to the position to regulate rear ends of recording media stacked in the cassette 1. That is, the end fence guide part 13 of the tray expansion/contraction part 1A forms a moving path of the end fence 31 as the rear end regulation member. More specifically, as illustrated in FIG. 3A and FIG. 4, an elongated slit (in FIG. 4, denoted with the reference symbol 13B) is formed at the center of the end fence guide part 13 in the direction orthogonal to the direction in which recording media are fed, a pin (not shown) provided to the bottom face of the end fence 31 is caused to fit in and pass through the elongated slit 13B, and the end fence 31 is supported by the end fence guide part 13 to freely slide in the direction in which recording media stacked in the cassette 1 are fed and in the backward direction. Thus, the end fence guide part 13 functions as a sliding guide part of the present invention provided to the tray expansion/contraction part 1A to support the end fence 31 to freely slide.

Referring to FIG. 4, rail parts 13R and 13R1, on which the bottom face of the end fence 31 is placed to slide, are provided at both sides of the elongated slit 13B of the end fence guide part 13. A rack, which engages with a locking member (not shown) provided to the end fence 31, is provided to the rail part 13R1. After the end fence 31 has moved to a position of regulating rear ends of recording media stacked in the cassette 1, by causing the locking member of the end fence 31 to be engaged with the rack of the rail part 13R1, the end fence 31 is kept in the position of regulating rear ends of the recording media stacked in the cassette 1.

The part of the end fence guide part 13 extending beyond the edge of the tray expansion/contraction part 1A is formed in a predetermined length such that, when the tray expansion/contraction part 1A is in the contracted position where the cassette 1 is contracted, the part of the end fence guide part 13 extending beyond the edge of the tray extension/contraction part 1A is put into a space formed by a cut part 2B (see FIG. 2) formed in the bottom part of the tray main body part 2.

As illustrated in FIG. 4, the elongated slit 13B between the rail parts 13R and 13R1 of the end fence guide part 13 is opened at the end part of the portion of the end fence guide part 13 extending beyond the edge of the tray expansion/contraction part 1A. Therefore, a mechanism to avoid the rail parts 13R and 13R1 from separating from each other and thereby the elongated slit 13B between the rail parts 13R and 13R1 from being spread outwardly is provided. That is, engaging holes 13A are formed in the upper surface of the end part of the portion of the end fence guide part 13 extending beyond the edge of the tray expansion/contraction part 1A, and a fall-off prevention member 33 can be engaged with the engaging holes 13A. When the sheet cassette 1 is used in the state in which sheet the cassette 1 can be expanded and contracted, the fall-off prevention member 33 is installed to the upper surface of the end part of the portion of the end fence guide part 13 extending beyond the edge of the tray expansion/contraction part 1A to across the elongated slit 13B as illustrated in FIG. 4.

Figure 5:
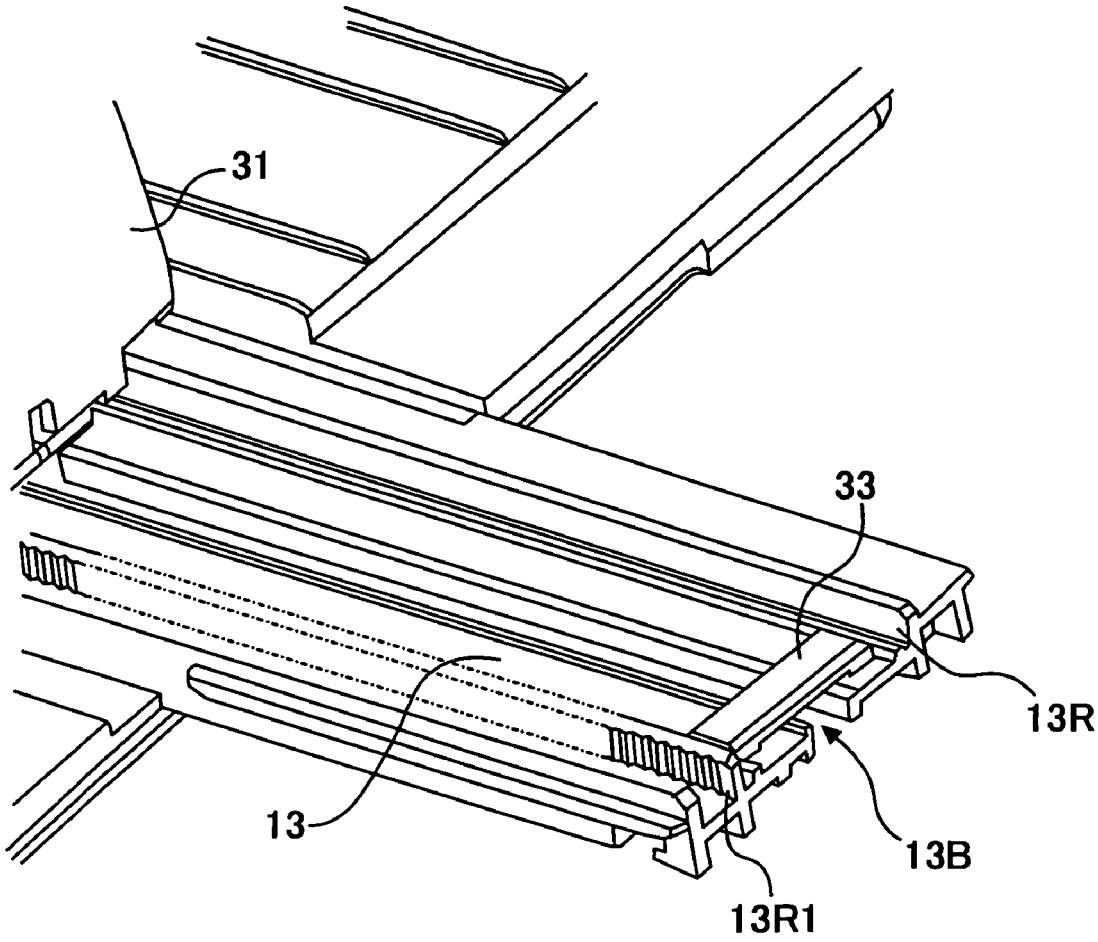
FIG. 5 is a diagram illustrating a state in which the fall-off prevention member is installed to the end fence guide part of the sheet cassette.

FIG. 5 illustrates a state in which the fall-off prevention member 33 is engaged with the engaging holes 13A.

The fall-off prevention member 33 can prevent the end fence 31 from being disengaged from the end part of the portion of the end fence guide part 13 extending beyond the edge of the tray expansion/contraction part 1A when the tray expansion/contraction part 1A is in the expanded position and the end part of the portion of the end fence guide part 13 extending beyond the edge of the tray expansion/contraction part 1A is separated from the edge of the cut part 2B of the tray main body part 2. Further, when the end part of the portion of the end fence guide part 13 extending beyond the edge of the tray expansion/contraction part 1A is formed in such a size that is smaller than the inside dimension of the cut part 2B of the tray main body part 2, the fall-off prevention member 33 holds the end part of the end fence guide part 13 such that the rail parts 13R and 13R1 are prevented from inadvertently separating from each other within a difference between the size of the end part of the end fence guide part 13 and the inside dimension of the cut part 2B of the tray main body part 2. Thereby, the end fence 31 can be prevented from being easily disengaged from the rail parts 13R and 13R1 of the end fence guide part 13.

Because the part of the end fence guide part 13 extending beyond the edge of the tray expansion/contraction part 1A is formed in the predetermined length as described above, when the tray expansion/contraction part 1A is in the expanded position where the sheet cassette 1 is expanded, a gap (in FIG. 17, denoted by the reference symbol SA) is generated in the space of the cut part 2B of the tray main body part 2 between the end of the part of the end fence guide part 13 extending beyond the edge of the tray expansion/contraction part 1A and the edge of the cut part 2B of the tray main body part 2. In this embodiment, as illustrated in FIG. 3A, an auxiliary rail 12 serving as an auxiliary member of the present invention can be installed to fill the gap SA between the end of the part of the end fence guide part 13 extending beyond the edge of the tray expansion/contraction part 1A and the edge of the cut part 2B of the tray main body part 2. By installing the auxiliary rail 12, the end fence guide part 13 of the tray expansion/contraction part 1A is extended, so that the length of the moving path of the end fence 31 as the rear end regulation member formed by the end fence guide part 13 of the tray expansion/contraction part 1A is extended.

Figure 6:
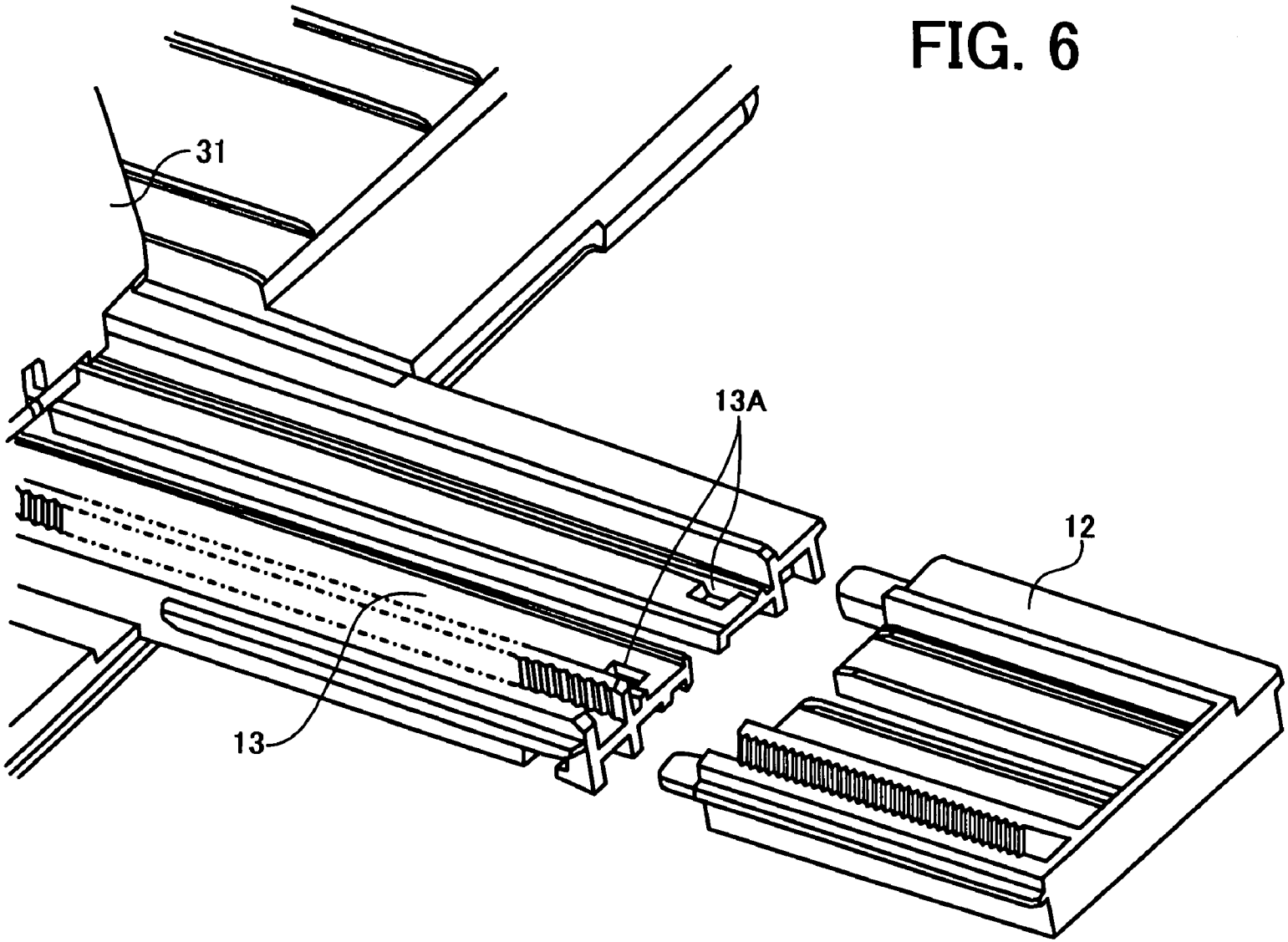
FIG. 6 is a diagram illustrating an auxiliary rail that is connected to the end fence guide part of the sheet cassette.

Referring to FIG. 6, the auxiliary rail 12 can be detachably attached to the end of the part of the end fence guide part 13 extending beyond the edge of the tray expansion/contraction part 1A. When the sheet cassette 1 is in the expanded state, by attaching the auxiliary rail 12 to the end of the part of the end fence guide part 13 extending beyond the edge of the tray expansion/contraction part 1A, the gap SA (FIG. 17), that is generated in the space of the cut part 2B of the tray main body part 2 between the end of the part of the end fence guide part 13 extending beyond the edge of the tray expansion/contraction part 1A and the edge of the cut part 2B of the tray main body part 2 when the tray expansion/contraction part 1A is in the expanded position where the sheet cassette 1 is expanded, is filled by the auxiliary rail 12, and thereby the moving path of the end fence 31 formed by the end fence guide part 13 of the tray expansion/contraction part 1A is extended. That is, the auxiliary rail 12 is a member to extend the length of the moving path of the end fence 31 formed by the end fence guide part of the tray expansion/contraction part 1A when the sheet cassette 1 is in the expanded state. Thus, when the sheet cassette 1 is used in the expanded state with the auxiliary rail 12 attached to the end fence guide part 13 of the tray expansion/contraction part 1A, the length of the moving path of the end fence 31 of the tray expansion/contraction part 1A is extended by the attached auxiliary rail 12 so that the end fence 31 can be moved up to the position, to which, in the contracted state of the cassette 1, the end fence 31 can be moved to regulate rear ends of recording media of a smaller size. Accordingly, even when recording media of a smaller size, which, when accommodated in the expanded state of the sheet cassette 1 used in the state in which the sheet cassette 1 can be expanded and contracted, cannot be regulated at rear ends thereof by the end fence 31, are accommodated in the sheet cassette 1, the end fence 31 can be moved to the position of regulating the recording media at the rear ends thereof.

The end part of the auxiliary rail 12 that is positioned at the side of the cut part 2B of the tray main body part 2 is arranged to contact the edge of the cut part 2B of the tray main body part 2. That is, the gap SA (FIG. 17) is filled with the auxiliary rail 12. Thereby, the tray expansion/contraction part 1A is regulated from being inadvertently moved in the direction in which the sheet cassette 1 is contracted.

Figure 7:
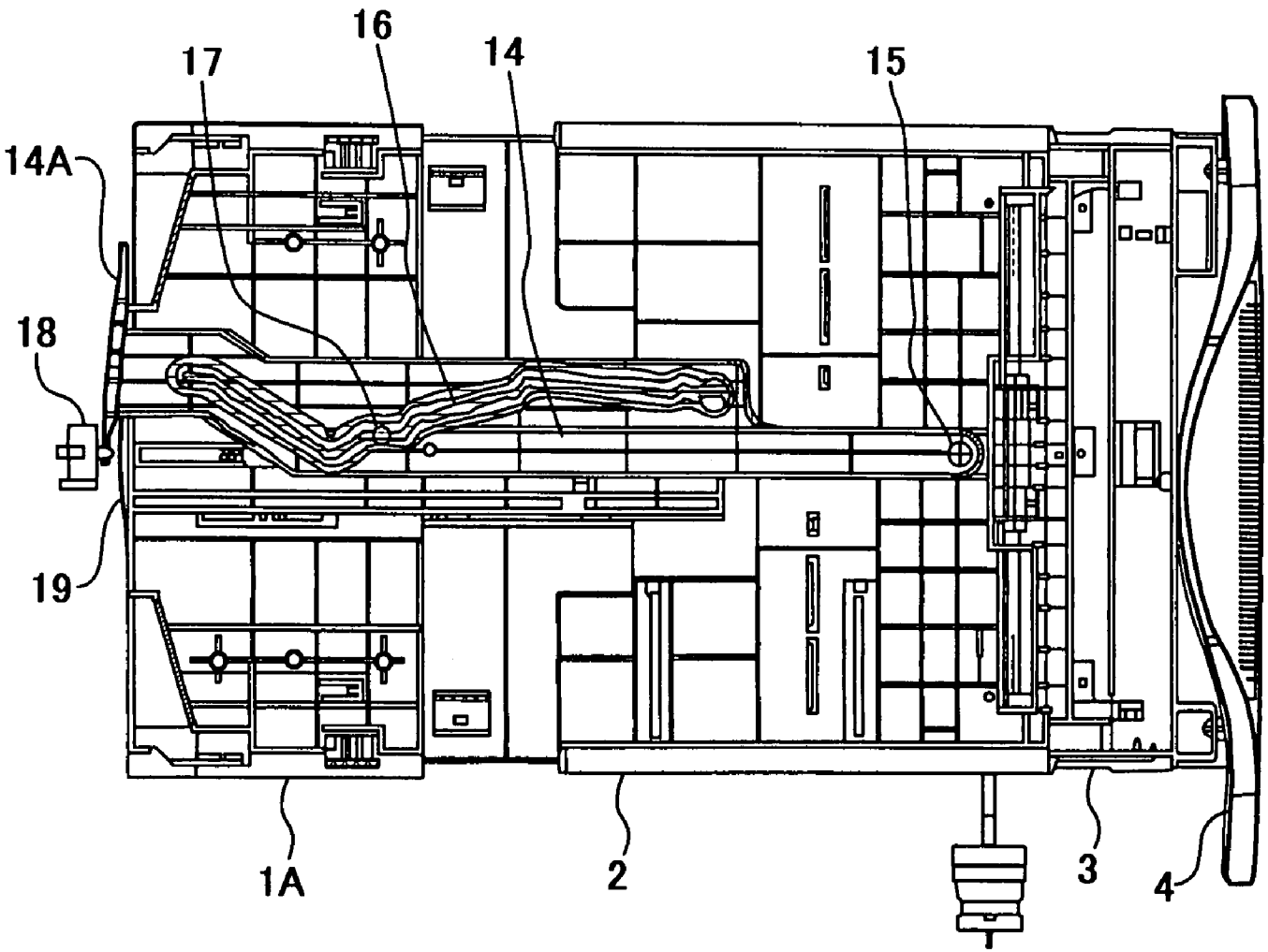
FIG. 7 is a bottom view of the sheet cassette in which a size detection plate is provided for detecting the size of recording media accommodated in the cassette.

FIG. 7 is a bottom view of the sheet cassette 1, and illustrates a mechanism arranged at the bottom surface of the sheet cassette 1 for detecting the size of recording media accommodated in the sheet cassette 1. Specifically, a size detection plate 14 is provided at the bottom surface of the sheet cassette 1. The size detection plate 14 is configured to swing around a pin 15 serving as a swing fulcrum provided at the end part of the tray main body part 2 corresponding to one side end of the sheet cassette 1 in the direction in which recording media accommodated in the cassette 1 are fed.

The swinging side end of the size detection plate 14, which is at the opposite side of the swing fulcrum, is located at the position where the rear end of the tray expansion/contraction part 1A, that corresponds to the other side end of the sheet cassette 1 in the direction in which recording media accommodated in the cassette 1 are fed, is located. A guide groove 16 is provided at a mid-way part of the size detection plate 14 leading to the swinging side end thereof, and a sliding pin 17 integrated with the bottom part of the end fence 31 (see FIG. 3A) is engaged with the guide groove 16.

The guide groove 16 is formed in a shape that enables the size detection plate 14 to swing according to movement of the sliding pin 17. That is, by moving the end fence 31 to the position of regulating rear ends of recording media stacked in the cassette 1, the sliding pin 17 integrated with the end fence 31 is moved and thereby the size detection plate 14 is swung.

Figure 8:
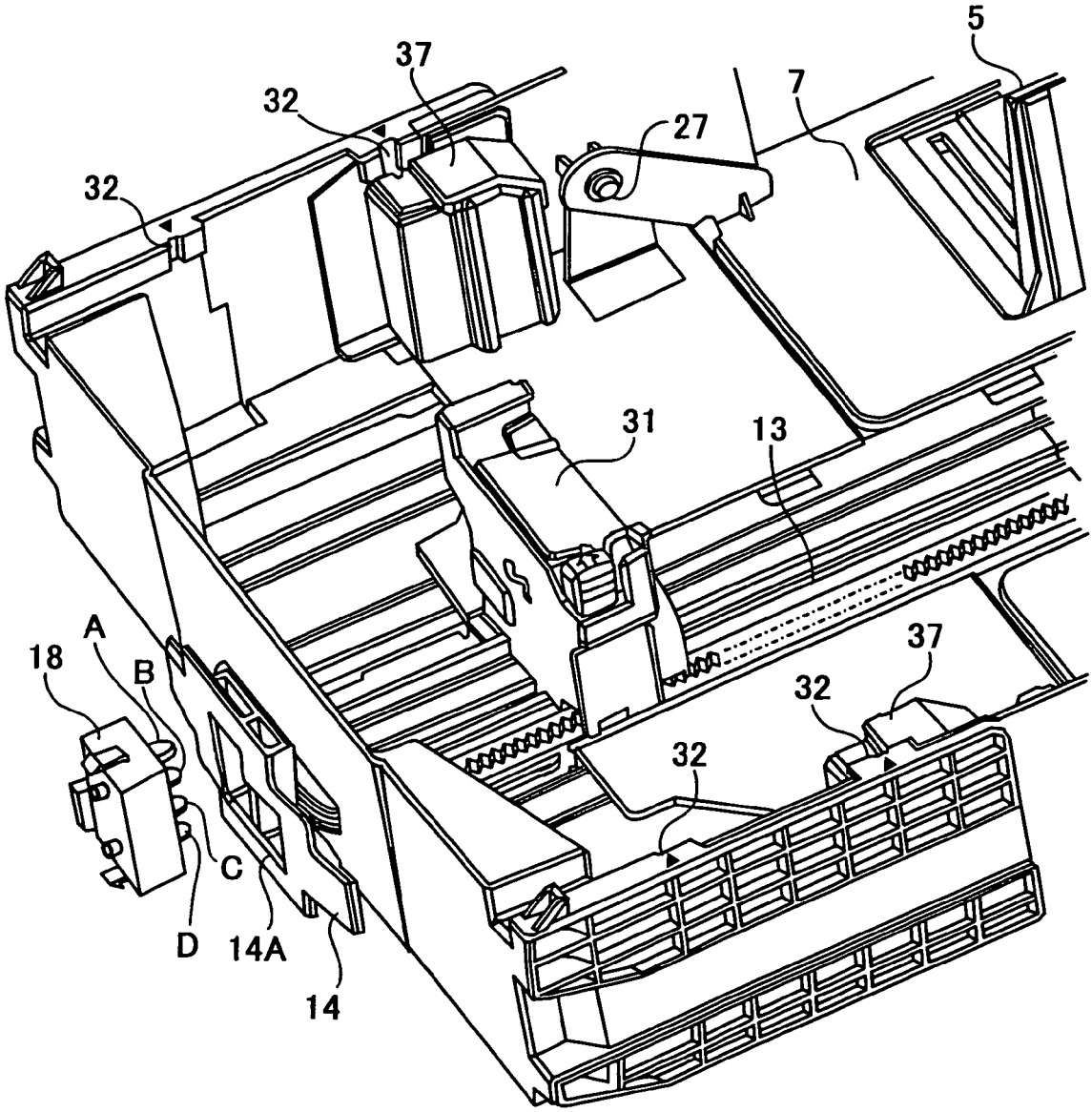
FIG. 8 is a perspective view illustrating a push switch and a cam part of the size detection plate for detecting the size of recording media accommodated in the sheet cassette.

Referring to FIG. 8, the position of the size detection plate 14 in the swing thereof is identified with a cam part 14A provided to the swinging side end part of the size detection plate 14 and a push switch 18 arranged in the sheet feeding part 100B to face the cam part 14A at the backside of the sheet cassette 1 in the direction in which the cassette 1 is pushed to be installed in the sheet feeding part 100B. The push switch 18 is operated by the cam part 14A. Actuators A, B, C and D matching with stepped shapes of the cam part 14A are provided to the push switch 18, and according to the position of the cam part 14A relative to the push switch 18, the combination of actuators A, B, C and D that are operated by the cam part 14A changes. Accordingly, the position of the size detection plate 14 in the swing thereof is identified based on the combination of the actuators A, B, C and D that have been operated by the cam part 14A, so that the position of the end fence 31 is detected, and thereby the size of recording media accommodated in the sheet cassette 1 is identified.

Figure 9A:
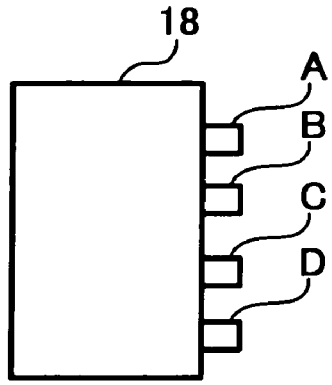
FIG. 9A is a diagram illustrating the push switch having actuators used in detecting the size of recording media accommodated in the sheet cassette.
Figure 9B:
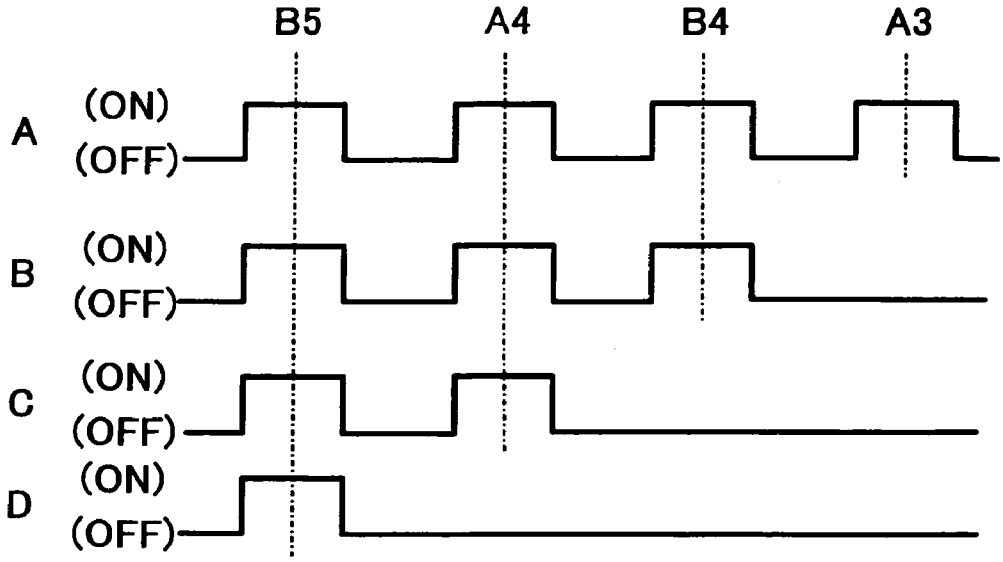
FIG. 9B is a diagram showing a relation between states of the actuators of the push switch and sizes of recording media accommodated in the sheet cassette.

FIG. 9A illustrates the push switch 18 with actuators A, B, C and D, and FIG. 9B illustrates a relation between sizes of recording media accommodated in the sheet cassette 1 and on/off states of the actuators A, B, C and D. The on/off states of the actuators A, B, C and D change according to the position of the cam part 14A of the size detection plate 14, and the size of recording media accommodated in the sheet cassette 1 is determined based upon the on/off states of the actuators A, B, C and D as illustrated in FIG. 9B.

In this embodiment, to prevent the cam part 14A of the size detection plate 14 from tilting due to a reaction force from the push switch 18 when the cam part 14A pushes the push switch 18 and thereby the force of pushing the pushing switch 18 with the cam part 14A is decreased so that an error is caused in detecting the position of the size detection plate 14 in the swing thereof, as illustrated in FIG. 7 a guide part 19 formed in an arc shape according with the swinging movement of the cam part 14A of the size detection plate 14 and capable of contacting the back face of the cam part 14A of the size detection plate 14 is provided to the rear end side surface of the tray expansion/contraction part 1A. Thereby, the cam part 14A of the size detection plate 14 can be prevented from being tilted toward the side of the swing fulcrum of the size detection plate 14 due to a reaction force from the push switch 18 when the cam part 14A pushes the push switch 18. Instead of providing the guide part 19 to the rear end side surface of the tray expansion/contraction part 1A, the guide part 19 may be provided to a portion of the size detection plate 14 near the cam part 14A such that the guide part 19 is located between the rear end side of the tray expansion/contraction part 1A and the cam part 14A.

In this embodiment, the size of recording media accommodated in the sheet cassette 1 is detected using the size detection plate 14 as a swing member having a swing radius along the direction in which recording media accommodated in the cassette 1 are fed. Therefore, the swing of the size detection plate 14 can be obtained large at the swinging side end thereof with a relatively small swing angle. The size detection plate 14 can be made relatively small in width in the widthwise direction of recording media as compared with a conventional cassette wherein a size detection device detecting the position of a side part of an end fence regulating rear ends of recording media stacked in the cassette is provided at one side end of the cassette in the widthwise direction of recording media, so that the weight of the size detection plate 14 is decreased and thereby the operating force for the end fence 31 is decreased, and the operability of the sheet cassette 1 is improved. Further, it is not necessary to excessively increase the size of the sheet cassette 1 in width in the direction in which recording media are fed as in the conventional cassette. Further, because the cam part 14A of the size detection plate 14 opposes the push switch 18 provided at the backside of the sheet cassette 1 in the direction in which the sheet cassette 1 is pushed to be installed in the sheet feeding part 100B of the color printer 100, differently from when a sensor part such as a push switch is provided in the direction orthogonal to the direction in which the sheet cassette 1 is pushed to be installed in the main body of an apparatus, the opposing position of the cam part 14A of the size detection plate 14 relative to the push switch 18 can be set. Therefore, the opposing relation of the cam part 14A relative to the push switch 18 can be stable, in contrast to the case wherein a sensor part is provided in the direction orthogonal to the direction in which the sheet cassette 1 is pushed.

Figure 10:
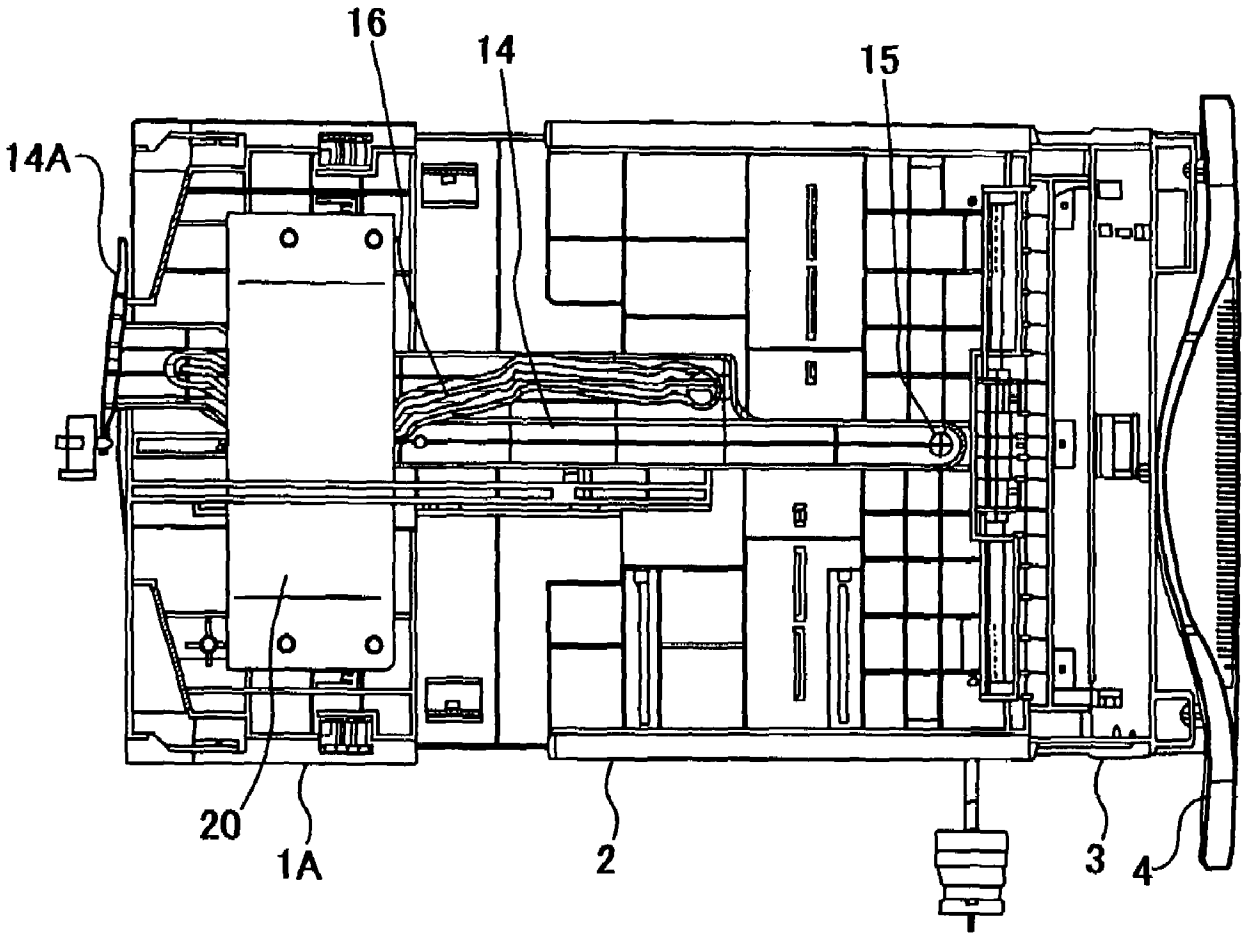
FIG. 10 is another bottom view of the sheet cassette in which an enforcing member is attached.

A reinforcing member 20 may be provided to the tray expansion/contraction part 1A as illustrated in FIG. 10 to prevent the tray expansion/contraction part 1A from extending in the widthwise direction of recording media accommodated in the sheet cassette 1.

The tray expansion/contraction part 1A uses the rail parts 13R and 13R1 at the end fence guide part 13 thereof and the elongated slit 13B is formed between the rail parts 13R and 13R1 as described above. Therefore, the bottom face of the tray expansion/contraction part 1A is discontinuous at the elongated slit 13B thereof. Further, as described above also, the elongated slit 13B between the rail parts 13R and 13R1 of the end fence guide part 13 is opened at the end part of the portion of the end fence guide part 13 extending beyond the edge of the tray expansion/contraction part 1A. Due to such structure of the end fence guide part 13, when the tray expansion/contraction part 1A is formed by resin molding, a problem can occur in that the end part of the end fence guide part 13 where the elongated slit 13B is opened extends in the widthwise direction of recording media and in that the tray expansion/contraction part 1A is loose or unstable due to lack of strength. Therefore, the reinforcing member 20 can be provided along the widthwise direction of recording media (orthogonal to the direction in which the sheet cassette 1 is expanded and contracted) to cross over the end fence guide part 13, in other words, to extend over the end fence guide part 13. Thereby, the tray expansion/contraction part 1A can be prevented from extending in the direction orthogonal to the direction in which the sheet cassette 1 is expanded and contracted, so that the positional accuracy of the tray expansion/contraction part 1A is maintained and changes in shape thereof can be prevented. A steel sheet having high rigidity may be used for the reinforcing member 20. The reinforcing member 20 is integrated by fasteners with the tray expansion/contraction part 1A in the state in which positioning pins (not shown) provided at both end parts of the reinforcing member 20 are engaged with positioning holes (not shown) provided to the tray expansion/contraction part 1A.

The reinforcing member 20 is arranged with a gap between the bottom face of the tray expansion/contraction part 1A and the reinforcing member 20, and the size detection plate 14 is inserted into the gap. Thereby, the reinforcing member 20 serves as a guide part for the size detection plate 14 in the vertical direction.

Figure 11:
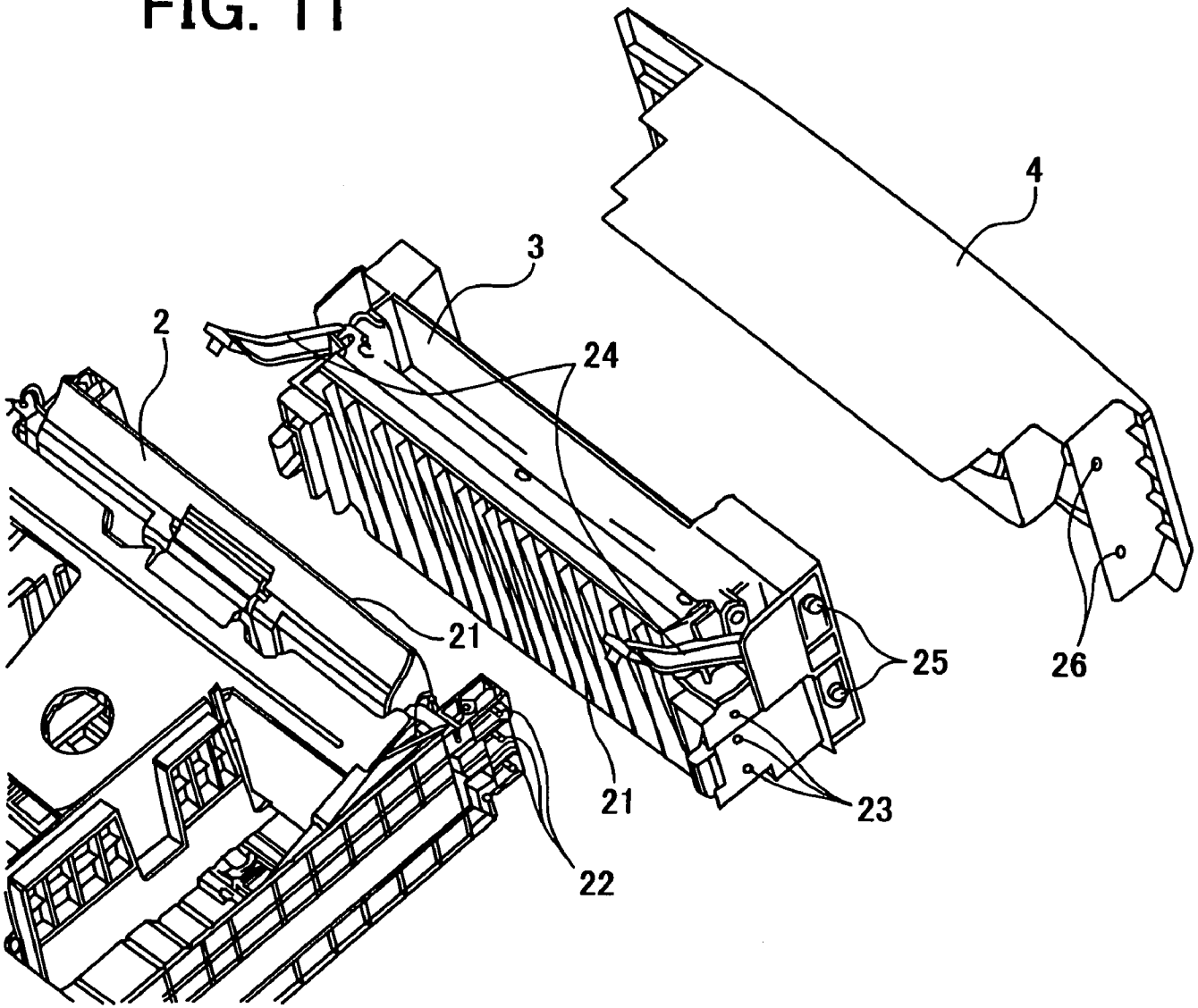
FIG. 11 is a diagram illustrating a conveying guide part and an outer cover part of the sheet cassette.

FIG. 11 illustrates the conveying guide part 3. A rib-state guide part 21 is provided to the end face of the conveying guide part 3, opposing the end face of the tray main body part 2 at the side where recording media are fed out. As illustrated in FIG. 11, a plurality of ribs extending along the direction in which recording media are fed are arranged in the rib-state guide part 21 side by side in the direction orthogonal to the direction in which the recording media are fed. The rib-state guide part 21 is separated from the end face of the tray main body part 2 at the side where recording media are fed out, so that a gap is formed between the rib-state guide part 21 and the end face of the tray main body part 2 to serve as a conveying path of recording media fed out from another sheet cassette 1 located at the lower side stand of the sheet feeding part 100B when a plurality of sheet cassettes 1 are arranged as illustrated in FIG. 1. The rib-state guide part 21 guides the recording media conveyed from the sheet cassette 1 located at the lower side stand of the sheet feeding part 100B to pass through the gap in cooperation with the end face of the tray main body part 2 opposing the rib-state guide part 21 of the conveying guide part 3 to the conveying path of recording media fed out from the cassettes 1 toward the registration rollers 100B3 (see FIG. 1).

The conveying guide part 3 is integrally supported by the tray main body part 2 together with the outer cover part 4, and as the supporting mechanism, positioning pins 22 are provided to sidewalls of the tray main body part 2 at the side where recording media are fed out and positioning holes 23 are provided to the conveying guide part 3 to correspond to the positioning pins 22. By engaging the sidewalls of the tray main body part 2 where the positioning pins 22 are provided with the conveying guide part 3 by taking advantage of elasticity of the sidewalls of the tray main body part 2, the positioning pins 22 are pushed into the positioning holes 23 provided to the conveying guide part 3. Thereby, the conveying guide part 3 is integrally supported by the tray main body part 2. Because the positioning pins 22 are pushed into the positioning holes 23, the position of the conveying guide part 3 relative to the tray main body part 2 is maintained, so that the dimension of the gap between the rib-state guide part 21 of the conveying guide part 3 and the end face of the tray main body part 2 serving as the conveying path of recording media fed out from another sheet cassette 1 located at the lower side stand of the sheet feeding part 100B can be maintained.

As described above, the conveying guide part 3 and the outer cover part 4 that are integrated with each other is attached to the tray main body part 2 by engaging the positioning pins 22 of the tray main body part 2 with the positioning holes 23 of the conveying guide part 3. Therefore, when realizing another type of the sheet cassette 1 for use in a different image forming apparatus, if it is desired to change the outer appearance of the sheet cassette 1 to match that of the image forming apparatus for example, it can be provided by changing the outer cover part 4 (and the conveying guide part 3) without changing the tray main body part 2. That is, the tray main body part 2 can be commonly used in different models of the sheet cassette 1. Accordingly, as compared with a case that the conveying guide part 3, the outer cover part 4 and the tray main body part 2 are integral with each other, in providing various types of the sheet cassette 1 for use in different image forming apparatuses, production cost and administrative expenses can be reduced.

In the above-described embodiment, the conveying guide part 3 and the outer cover part 4 are configured to be assembled with one another. However, the guide and cover parts may be integrally molded.

As illustrated in FIG. 11 (and in FIG. 3A), the conveying guide part 3 includes levers 24 serving as a raising/lowering member of the stacking plate 7. The levers 24 are configured to swing around swing fulcrums provided at both ends of the conveying guide part 3 in the widthwise direction of recording media. The springs 9 (FIG. 3A) as elastic members are hooked to the swinging side ends of the levers 24.

The levers 24 are members for raising the swinging side end of the stacking plate 7 by hooking ends of the springs 9, opposite the ends hooked to the levers 24, to the stacking plate 7. When the sheet cassette 1 is installed in the sheet feeding part 100B of the color printer 100, the levers 24 are caused to swing in the arising direction by a guide member provided in the sheet feeding part 100B of the color printer 100 as described below. Thereby, the swinging side end of the stacking plate 7 is raised, so that the stacking plate 7 swings in the direction in which the swinging side end of the stacking plate 7 is caused to contact the feeding roller 10 provided in the sheet feeding part 100B of the color printer 100 as illustrated in FIG. 3A. Thereby, the upper most one of recording media stacked on the stacking plate 7 is pressed to contact the feeding roller 10 to be fed out by rotation of the feeding roller 10.

Figure 12A:
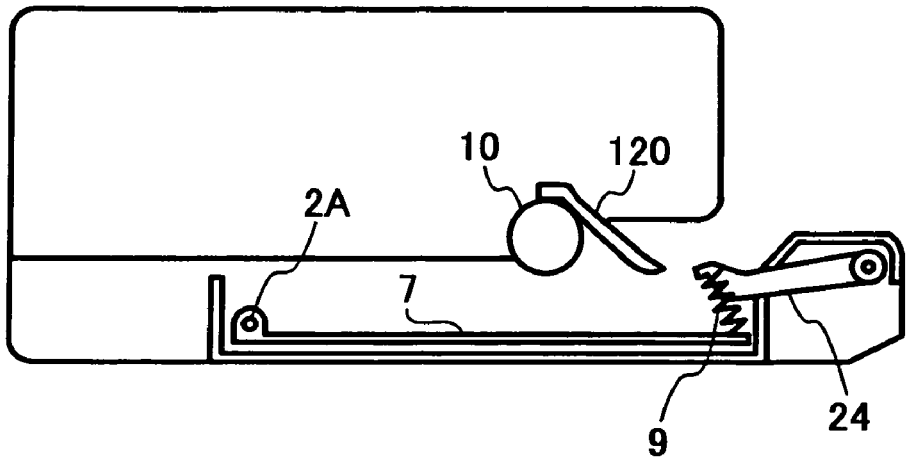
FIG. 12A and FIG. 12B are schematic diagrams showing raising a stacking plate of the sheet cassette, FIG. 12A illustrating a state before the cassette has been installed in the apparatus and FIG. 12B illustrating a state after the cassette has been installed in the apparatus.
Figure 12B:
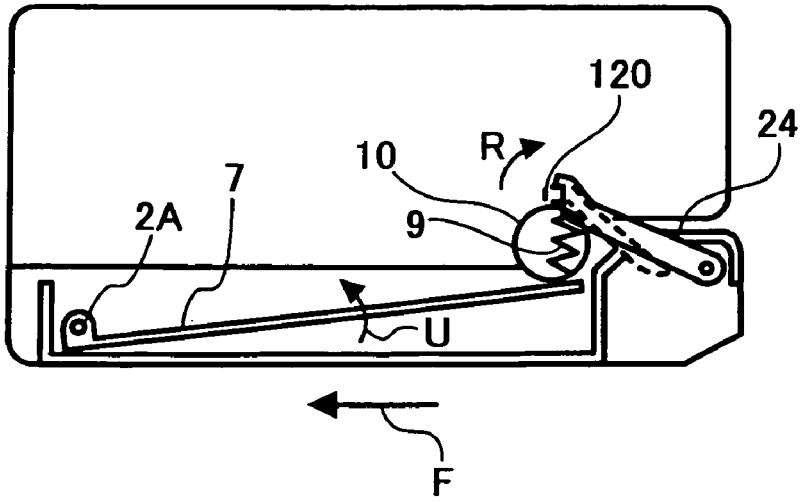

FIG. 12A and FIG. 12B illustrate states in which the levers 24 are raised and thereby the stacking plate 7 is raised. When the sheet cassette 1 is inserted into the sheet feeding part 100B of the color printer 100 to be installed, as illustrated in FIG. 12A the swinging side ends of the levers 24 start to slide on raising guide members 120 provided in the sheet feeding part 100B of the color printer 100. As the sheet cassette 1 is further pushed into the sheet feeding part 100B of the color printer 100, as illustrated in FIG. 12B the levers 24 slide on the raising guide members 120 to be moved in the direction indicated by the arrow R in FIG. 12B. Thereby, the springs 9 are pulled up, and as a result, the swinging side end of the stacking plate 7 is moved in the direction indicated by the arrow U. In this embodiment, the pulling force of the springs 9 is set such that when no recording media are placed on the stacking plate 7, the stacking plate 7 contacts the feeding roller 10.

When the sheet cassette 1 has been drawn out and detached from the sheet feeding part 100B of the color printer 100, the levers 24 are released from being raised by the raising guide members 120 of the sheet feeding part 100B of the color printer 100. Thereby, the levers 24 come down, and thereby the stacking plate 7 comes down also, so that pressure contact between the feeding roller 10 and the recording media stacked on the stacking plate 7 is released.

In this embodiment, the swinging side ends of the levers 24 are raised by the guide members 120 provided in the sheet feeding part 100B of the color printer 100 as described above. However, the swinging side ends of the levers 24 can be raised without using such a member provided in the sheet feeding part 100B of the color printer 100. For example, by forming the swinging fulcrum side parts of the levers 24 in crank-like shapes and by configuring the levers 24 such that the swinging fulcrum side parts thereof are rotated to and stopped at a predetermined angle by manipulation of an operation part provided to the conveying guide part 3, the swinging side ends of the levers 24 can be raised with rotation of the swinging fulcrum side ends of the levers 24.

In this embodiment, as described above, the levers 24 are provided to the conveying guide part 3 of the cassette 1. Therefore, when realizing another type of the sheet cassette 1 for use in a different image forming apparatus, even if the sheet cassette 1 is desired to be changed in contact pressure and/or contact timing between recording media and a feeding roller of the apparatus, it can be provided by changing the conveying guide part 3 (and the outer cover part 4 when integrated with the conveying guide part 3) without changing the tray main body part 2. Further, even when the shape of the conveying path of recording media fed from another sheet cassette 1 at the lower side stand is desired to be changed, it can be provided by changing the conveying guide part 3 without changing other parts of the sheet cassette 1.

Now, the outer cover part 4 is described with reference to FIG. 11. The outer cover part 4 is made of an elastic member such as resin, and is attached to the conveying guide part 3 with high positional accuracy by engaging positioning pins 25 provided to right side and left side faces of the conveying guide part 3, i.e., both side faces of the conveying guide part 3 in the widthwise direction of recording media, with positioning holes 26 provided to both side walls of the outer cover part 4 to correspond to the engaging positioning pins 25, while taking advantage of elasticity of the outer cover part 4. Thereby, a step and/or gap between outer faces of the sheet cassette 1 and the main body of the color printer 100 when the sheet cassette 1 has been installed can be set as desired. Further, when realizing another type of the sheet cassette 1 for use in a different image forming apparatus, if the exterior design and the color of the sheet cassette 1 are desired to be changed for example to match the image forming apparatus, it can be provided by changing the outer cover part 4 (and the conveying guide part 3) without changing other parts of the sheet cassette 1.

A positioning part for positioning the sheet cassette 1 relative to the sheet feeding part 100B of the color printer 100 when the sheet cassette 1 is installed in the sheet feeding part 100B of the color printer 100 is provided, though not shown, to the conveying guide part 3. A member protruding from the sheet feeding part 100B of the color printer 100 is sandwiched in a gutter formed in the positioning part of the conveying guide part 3, and thereby the posture of the sheet cassette 1 relative to the sheet feeding part 100B of the color printer 100 is regulated.

The sheet cassette 1 in this embodiment is provided with a paper end detection part detecting that recording media stacked on the stacking plate 7 have run out.

Figure 13:
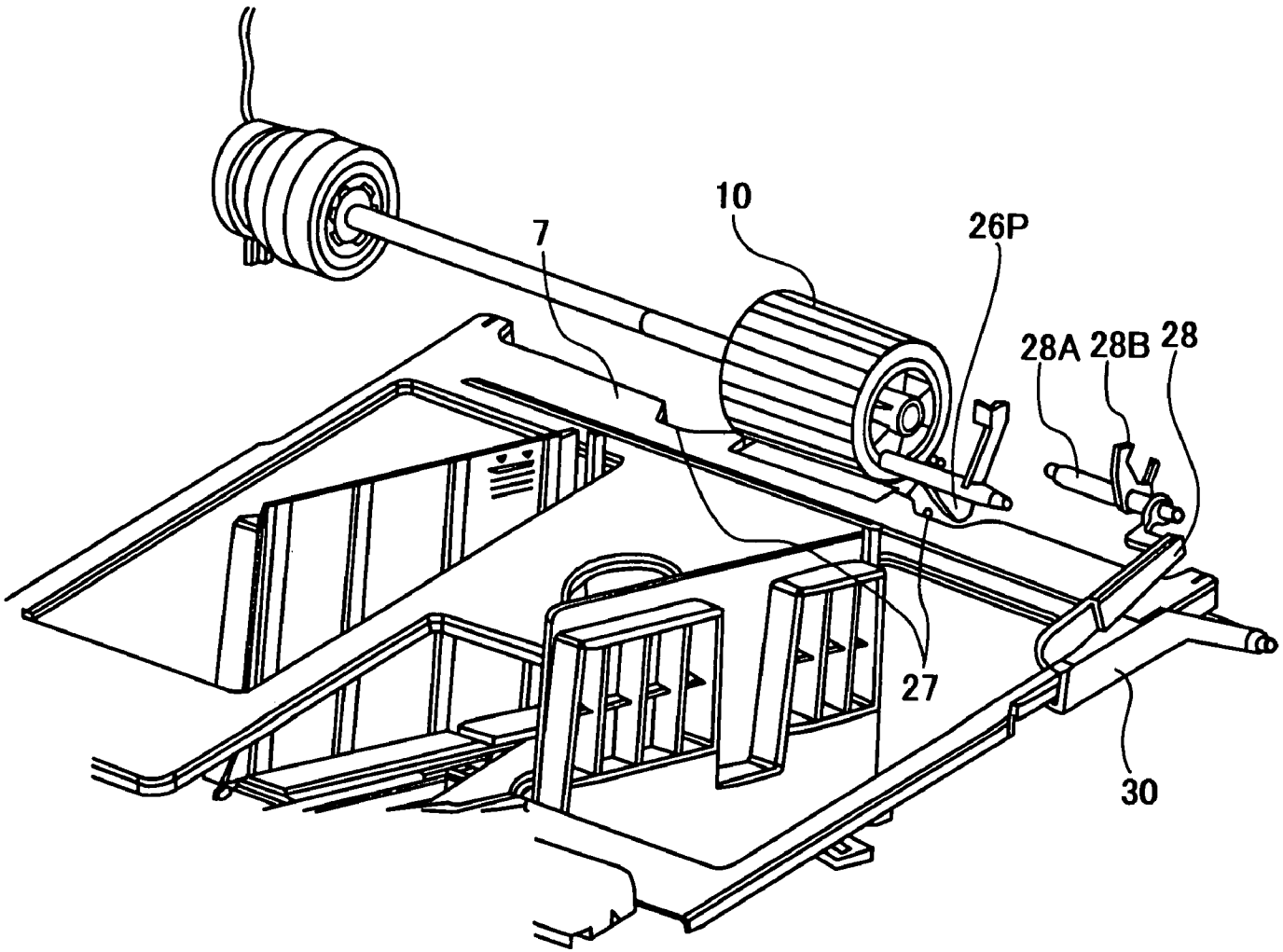
FIG. 13 is a diagram illustrating a paper end detection mechanism and a remaining quantity detection mechanism provided to the sheet cassette.

FIG. 13 illustrates an example of the paper end detection part of the sheet cassette 1. The stacking plate 7 is provided with a cut part 27 at the swinging side edge thereof at the position corresponding to a feeler 26P provided in the sheet feeding part 100B of the color printer 100 to serve as a paper end detection sensor. The cut part 27 serves as a pass-through part of the feeler 26P. The cut part 27 is provided at two positions of the swinging side edge of the stacking plate 7 that are symmetrical to each other with the center of the conveying path of recording media as the symmetry center. Thereby, the feeler 26P of the sheet feeding part 100B of the color printer 100 as the paper end detection sensor can be positioned at either side of the feeding roller 10 depending upon the conditions of the color printer 100. That is, the cassette 1 can be used regardless of at which side of the feeding roller 10 the feeler 26P is located in the sheet feeding part 100B of the color printer 100. Further, when realizing another type of the sheet cassette 1 for use in a different image forming apparatus, even if the conveying guide part 3 and/or the outer cover part 4 is desired to be changed to match the image forming apparatus, the tray main body part 2 and the tray expansion/contraction part 1A need not be changed regardless of at which side of a feeding roller a feeler as a paper end detection sensor is located in the apparatus.

Figure 14:
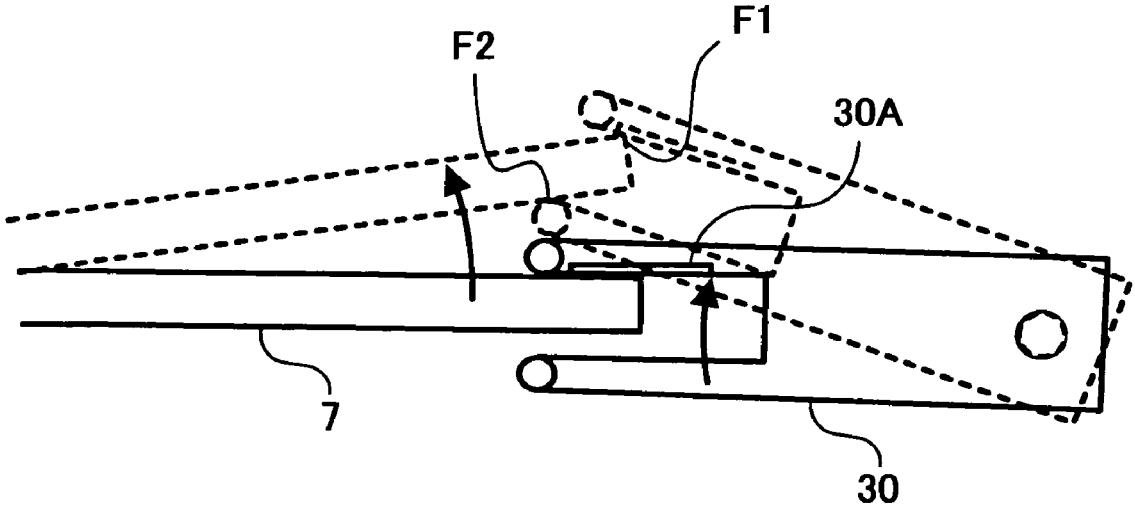
FIG. 14 is a schematic diagram showing an operation of a member used in the remaining quantity detection mechanism.

A mechanism to detect a remaining quantity of recording media stacked on the stacking plate 7 is also provided to the sheet cassette 1. The mechanism uses a feeler 28 as a remaining quantity detect device illustrated in FIG. 13. The remaining quantity detection feeler 28 is a swinging member to swing around a support axis 28A provided to the sheet feeding part 100B of the color printer 100, and the swinging side end thereof is caused to move according to movement of the swinging side end of the stacking plate 7 by a mechanism described below. An actuator 28B formed in a bifurcate shape and capable of interrupting optical paths of photo-interrupters (not shown) depending upon the position of the swinging side end of the stacking plate 7 is provided to the support axis 28A serving as the swinging fulcrum of the remaining quantity detection feeler 28. By providing two photo-interrupters, detection of the remaining quantity of recording media stacked on the stacking plate 7 can be made in four steps based upon states of the actuator 28B, i.e., a state in which the actuator 28B interrupts both of the optical paths of the photo-interrupters, a state in which the actuator 28B transmits both of the optical paths, and states in which the actuator 28B interrupts one of the optical paths and transmits the other of the optical paths. In this embodiment, the position of the swinging side end of the remaining quantity detection feeler 28 is changed by a remaining quantity detection auxiliary feeler 30 provided to the side face of the end part of the tray main body part 2 at one side in the widthwise direction of recording media and configured to move as the position of the swinging side end of the stacking plate 7 is changed according to the remaining quantity of recording media stacked on the stacking plate 7. The swinging side end of the remaining quantity detection feeler 28 is in contact with the remaining quantity detection auxiliary feeler 30, so that as the remaining quantity detection auxiliary feeler 30 is moved, the swinging side end of the remaining quantity detection feeler 28 is moved. More specifically, the remaining quantity detection auxiliary feeler 30 is rotatably supported by an axis with bearings provided to the end part of the tray main body part 2 at one side of the tray main body part 2 in the widthwise direction of recording media, and as illustrated in FIG. 14, an opening is formed at the swinging side end part thereof such that a swinging side end part of the stacking plate 7 is inserted in the opening and is sandwiched by upper side and lower side parts of the opening. The remaining quantity detection auxiliary feeler 30 is placed on the stacking plate 7 by its own weight. Thereby, when the swinging side end of the stacking plate 7 moves up and down, the swinging side end of the remaining quantity detection auxiliary feeler 30 also moves up and down, so that the position of the swinging side end of the remaining quantity detection feeler 28 provided to the sheet feeding part 100B of the color printer 100 is changed according to the position of the swinging side end of the remaining quantity detection auxiliary feeler 30. Thereby, detection of the remaining quantity of recording media stacked on the stacking plate 7 can be made in four steps as described above using the remaining quantity detection feeler 28.

The remaining quantity detection auxiliary feeler 30 can be alternatively supported by the axis provided to the end part of the tray main body part 2 at the other side of the tray main body part 2 in the widthwise direction of recording media. Thereby, the sheet cassette 1 can be used regardless of at which side of the feeding roller 10 the remaining quantity detection feeler 28 is located in the sheet feeding part 100B of the color printer 100. Further, when realizing another type of the sheet cassette 1 for use in a different image forming apparatus, even if the conveying guide part 3 and/or the outer cover part 4 need to be changed to match the image forming apparatus, the tray main body part 2 and the tray expansion/contraction part 1A need not be changed at whichever side of a feeding roller a feeler as a remaining quantity detection sensor is located in the apparatus.

Further, as illustrated in FIG. 14, a locking piece 30A is provided to the internal surface of the upper side part of the remaining quantity detection auxiliary feeler 30 sandwiching the stacking plate 7 at a part at the side of the swinging fulcrum more than the part of the remaining quantity detection feeler 30 sandwiching the swinging side end part of the stacking plate 7 to protrude toward and to contact the upper face of the stacking plate 7, so that the swinging upper limit position of the swinging side end of the stacking plate 7 when the stacking plate 7 is swung can be regulated. That is, in FIG. 14, because the swinging directions of the stacking plate 7 and the remaining quantity detection auxiliary feeler 30 are opposite to each other, when the stacking plate 7 is raised, as indicated by two-dashed lines in figure, upper and lower faces of the swinging side end of the stacking plate 7 contact internal faces of the above-described locking piece 30A provided to the upper side part and the lower side part of the remaining quantity detection auxiliary feeler 30 sandwiching the stacking plate 7 at the positions indicated by F1 and F2, respectively. In this state, even if the stacking plate 7 is raised, because the upper and lower faces of the stacking plate 7 remain in contact with the internal faces of the remaining quantity detection auxiliary feeler 30 sandwiching the stacking plate 7, swinging of the swinging side end of the stacking plate 7 is regulated. Thereby, the swinging side end of the stacking plate 7 that is raised by the springs 9 (see FIG. 3A) can be prevented from being swung more than the height of the walls of the tray main body part 2, so that so-called rapid bouncing of the stacking plate 7 can be prevented.

With the above-described configuration, the sheet cassette 1 can be used in two states, i.e., one state in which the sheet cassette 1 can be expanded and contracted and the other state in which the sheet cassette 1 is in the expanded state with the auxiliary rail 12 attached to the end of the end fence guide part 13 of the tray expansion/contraction part 1A, and in both of the states, recording media accommodated in the sheet cassette 1 can be satisfactorily fed out regardless of sizes of the recording media. In particular, when the sheet cassette 1 is used in the state in which the sheet cassette 1 can be expanded and contracted, the fall-off prevention member 33 is provided to the end part of the end fence guide part 13 of the tray expansion/contraction part 1A, so that the end fence 31 can be prevented from being inadvertently fallen off in particular when the sheet cassette 1 is in the expanded state and the end of the end fence guide part 13 of the tray expansion/contraction part 1A is distant from the edge of the cut part 2B of the tray main body part 2. When the sheet cassette 1 is used in the expanded state with the auxiliary rail 12 attached to the end of the end fence guide part 13 of the tray expansion/contraction part 1A, the length of the moving path of the end fence 31 of the tray expansion/contraction part 1A is extended by the attached auxiliary rail 12 so that the end fence 31 can be moved up to the position, to which, in the contracted state of the cassette 1, the end fence 31 can be moved to regulate rear ends of recording media of a smaller size. Thereby, even when recording media of a smaller size, which, when accommodated in the expanded state of the sheet cassette 1 used in the state in which the sheet cassette 1 can be expanded and contracted, cannot be regulated at rear ends thereof by the end fence 31, are accommodated, the recording media can be regulated at rear ends thereof by the end fence 31, so that satisfactory feeding out of the recording media is provided.

Further, detection of the remaining quantity of recording media stacked on the stacking plate 7 of the sheet cassette 1 and detection of running out of the recording media are performed by the members such as feelers provided in the sheet feeding part 100B of the color printer 100 in which the sheet cassette 1 is installed. Therefore, the major parts of the sheet cassette 1, i.e., the tray expansion/contraction part 1A, the tray main body part 2, the end fence 31, and the enforcement member 20 need not be changed based upon the conditions of the sheet feeding part 100B of the color printer 100. That is, the major parts of the sheet cassette 1 can be commonly used when the sheet cassette 1 is used in different image forming apparatuses.

Now, another preferred embodiment of the present invention is described.

Figure 15:
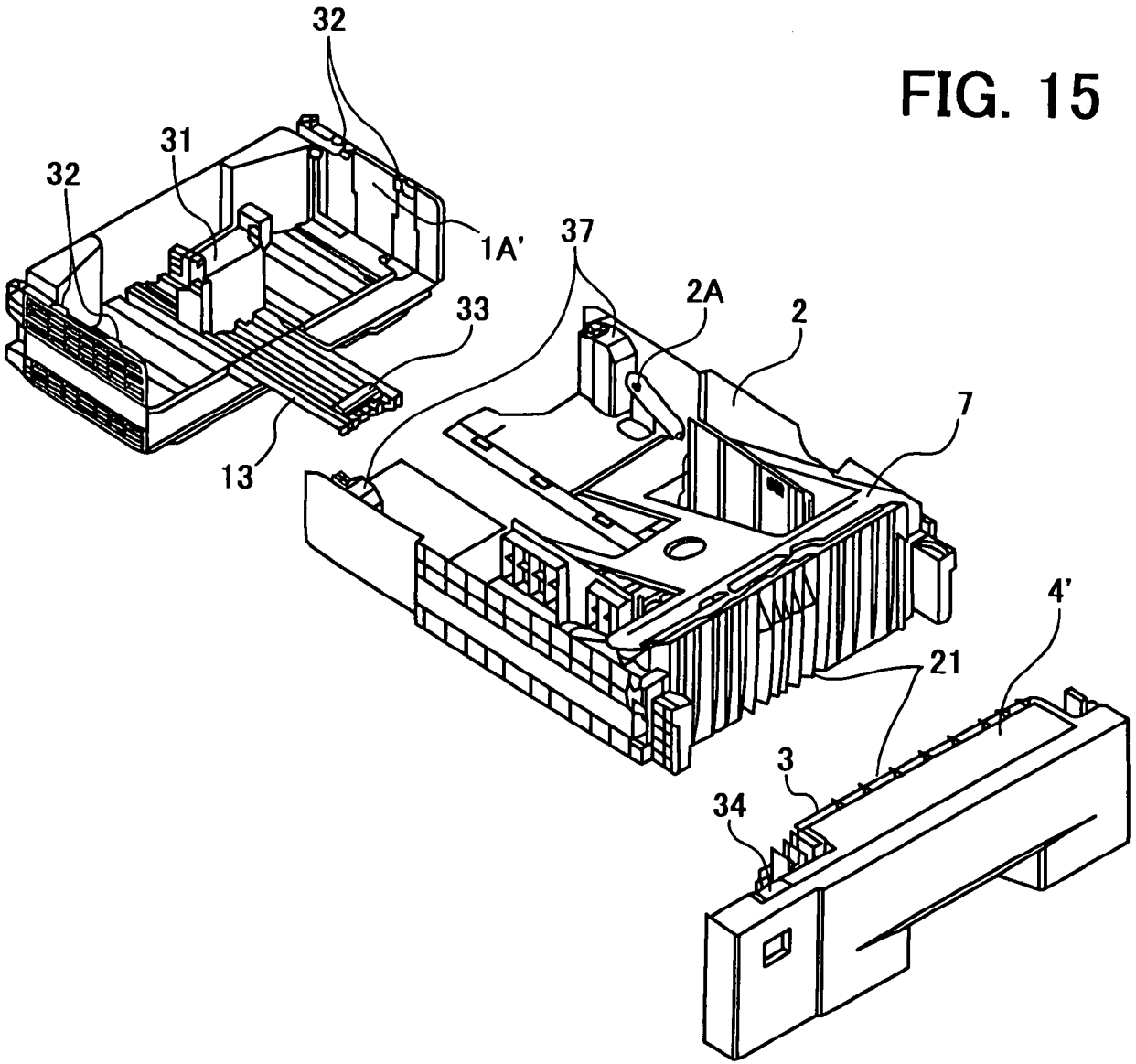
FIG. 15 is a diagram illustrating another embodiment of the sheet cassette.

FIG. 15 illustrates a sheet cassette 1' configured to be expanded and contracted by an operation of the user. The sheet cassette 1' includes a tray expansion/contraction part 1A', the tray main body part 2, and an outer cover part 4'. The outer cover part 4' is integrated with the conveying guide part 3 illustrated in FIG. 2. In FIG. 15, parts corresponding to or identical with those members of FIG. 2 and FIG. 3A are denoted by the same reference symbols.

Figure 16:
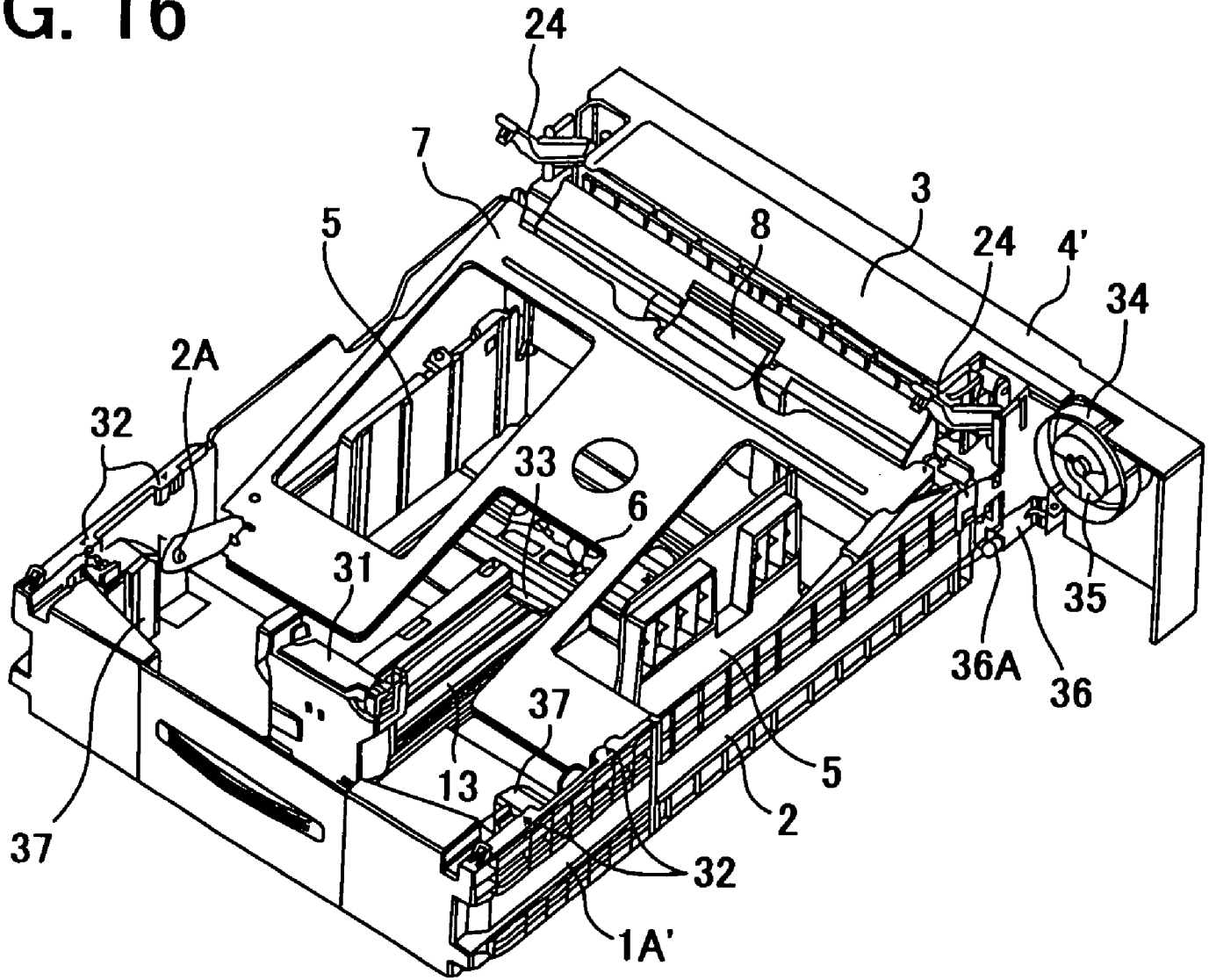
FIG. 16 is a diagram illustrating a contracted state of the sheet cassette of FIG. 15.

The sheet cassette 1' is held in the contracted and expanded states (the states illustrated in FIG. 16 and FIG. 17, respectively) by putting the tray expansion/contraction part 1A' in the contracted position and the expanded position and by inserting the protruding members 37A of the locking members 37 into the groove parts 32 of the tray expansion/contraction part 1A' as in the previous embodiment.

In the sheet cassette 1', the maximum size of recording media that can be accommodated when the sheet cassette 1' is in the contracted state is set to the A4 size, for example, and the maximum size of recording media that can be accommodated when the sheet cassette 1' is in the expanded state is set to the legal size which is larger than the A4 size, for example.

Figure 17:
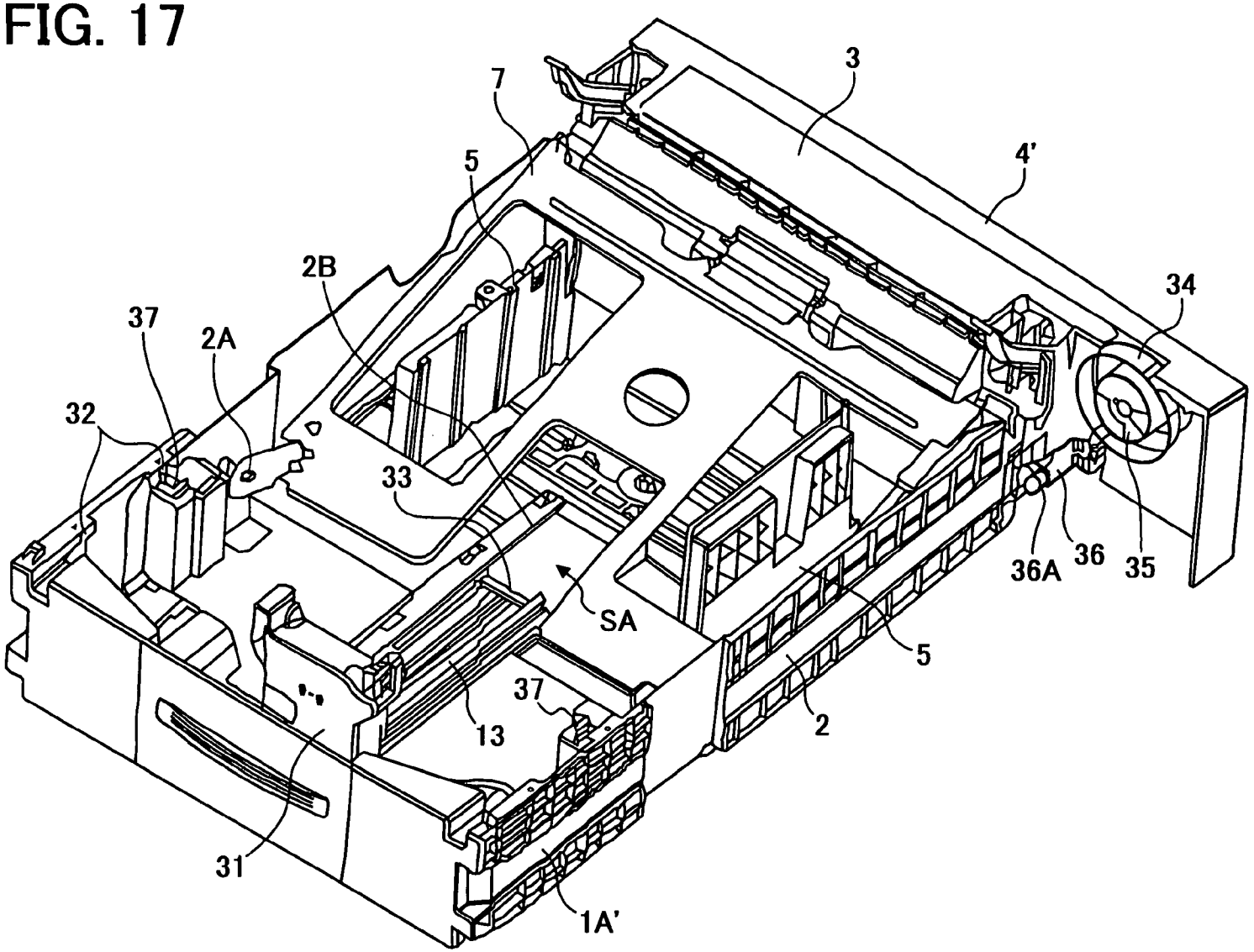
FIG. 17 is a diagram illustrating an expanded state of the sheet cassette of FIG. 15.

When the sheet cassette 1' is in the expanded state illustrated in FIG. 17, because the auxiliary rail 12 is not used in this embodiment, unlike the previous embodiment, the end of the part of the end fence guide part 13 extending beyond the edge of the tray expansion/contraction part 1A' is separated from the edge of the cut part 2B of the tray main body part 2 in the space SA of the cut part 2B of the tray main body part 2. In this state, because the fall-off prevention member 33 is attached to the end part of the end fence guide part 13 to cross over the rail parts 13R and 13R1 (FIG. 5) of the end fence guide part 13, the end fence 31 can be prevented from falling off.

The sheet cassette 1' can omit the size detection plate 14 that is provided to the sheet cassette 1 of the previous embodiment. Instead, a disk-like size set dial 34 is provided to the outer cover part 4' such that a part of the periphery of the size set dial 34 can be seen through an opening provided to the outer cover part 4'.

Indicators indicating sizes of recording media are marked on the periphery surface of the size set dial 34, and by manually rotating the size set dial 34, the part of the periphery of the size set dial 34 that can be seen through the opening provided to the outer cover part 4' is changed, and thereby the size indicated by the size set dial 34 is changed.

A cam part 35 is provided to the end surface of the size set dial 34 in the axial direction thereof, and a push switch (not shown) is provided to contact the cam part 35. Thereby, by rotating the size set dial 34, the relation of the cam part 35 relative to the push switch changes, so that the size of recording media can be set.

As a mechanism for integrating the outer cover part 4' with the tray main body part 2, a flexible locking piece 36 fixed to the outer cover part 4' at its base end and having a locking roller 36A at its swinging side end and an engaging part provided to the tray main body part 2 are used. The engaging part of the tray main body part 2 includes, though not shown, a concave and convex part into which the locking roller 36A of the locking piece 36 can enter after sliding thereon. When attaching the outer cover part 4' to the tray main body part 2, the locking piece 36 once bends to be deformed and slides on the concave and convex part of the engaging part of the tray main body part 2, and then enters into the concave of the concave and convex part. Thereby, the outer cover part 4' is integrated with the tray main body part 2 in the state in which the outer cover part 4' can be prevented from falling off.

With the above-described configuration, the sheet cassette 1' can be expanded and contracted by moving the tray expansion/contraction part 1A' to the expanded position and the contracted position. Therefore, in the color printer 100, the sheet cassette 1' can be used in the expanded or contracted state or the sheet cassette 1' can be used while being expanded and contracted depending upon sizes of recording media. Thus, regardless of how the sheet cassette 1' is used in the color printer 100, the tray expansion/contraction part 1A', the tray main body part 2, and the outer cover part 4' that is integrated with the conveying guide part 3, of the sheet cassette 1' can be commonly used.

Numerous additional modifications and variations of the present invention are possible in light of the above-teachings. It is therefore to be understood that within the scope of the appended claims, the present invention can be practiced otherwise than as specifically described herein.

What is claimed is:

1. A sheet cassette comprising:

a tray main body part;

a tray expansion/contraction part supported by the tray main body part and configured to slide relative to the tray main body part to a cassette expanded position where the sheet cassette is in an expanded state and a cassette contracted position where the sheet cassette is in a contracted state, the tray expansion/contraction part comprising a rear end regulation member configured to be moved in a direction in which recording media stacked in the sheet cassette are fed to regulate rear ends of the recording media and a sliding guide part configured to support the rear end regulation member to freely slide and to form a moving path of the rear end regulation member; and an auxiliary member that is configured to be attached, when the tray expansion/contraction part is in the cassette expanded position, to the sliding guide part of the tray expansion/contraction part to extend a length of the moving path of the rear end regulation member of the tray expansion/contraction part between the tray expansion/contraction part and the tray main body part and is configured to be detached from the sliding guide part of the tray expansion/contraction part when the tray expansion/contraction part is in the cassette contracted position.

2. The sheet cassette according to claim 1, further comprising:

a fall-off prevention member provided to an end part of the sliding guide part of the tray expansion/contraction part at the side of the tray main body part and configured to prevent the rear end regulation member from falling off the sliding guide part.

3. The sheet cassette according to claim 1, further comprising:

a reinforcing member provided to a backside surface of the tray expansion/contraction part.

4. The sheet cassette according to claim 1, wherein the auxiliary member is configured, when the cassette is in the expanded state, to connect, at one side end thereof, with an end of the sliding guide part of the tray expansion/contraction part in the direction in which the recording media are fed and to contact the tray main body part at the other side end thereof.

5. The sheet cassette according to claim 2, wherein the fall-off prevention member is disposed across the sliding guide part of the tray expansion/contraction part such that ends thereof engage the sliding guide part.

6. The sheet cassette according to claim 3, wherein the reinforcing member extends across the sliding guide part of the tray expansion/contraction part and is integrated with the tray expansion/contraction part at both ends thereof in a direction in which the reinforcing member is extended and is configured to prevent the tray expansion/contraction part from extending in a direction orthogonal to a direction in which the tray expansion/contraction part slides.

7. The sheet cassette according to claim 1, wherein the tray main body part comprises holding parts configured to hold the tray expansion/contraction part at the cassette expanded position and the cassette contracted position and an indication part configured to differentiate a state that the tray expansion/contraction part is held by the tray main body part from a state that the tray expansion/contraction part is released from being held by the tray main body part.

8. The sheet cassette according to claim 7, wherein the tray expansion/contraction part comprises engaging members, and the holding parts of the tray main body part comprise locking parts configured to engage with and disengage from the engaging members of the tray expansion/contraction part, and the indication part is configured to differentiate a state that the tray expansion/contraction part is held by the tray main body part from a state that the tray expansion/contraction part is released from being held by the tray main body part according to engaging states of the engaging members of the tray expansion/contraction part and the locking parts of the tray main body part.

9. A sheet feeding device comprising:

a sheet cassette configured to receive recording media;

a feeding roller configured to feed the recording media in the sheet cassette, wherein the sheet cassette comprises a tray main body part, and a tray expansion/contraction part supported by the tray main body part and configured to slide relative to the tray main body part to a cassette expanded position where the sheet cassette is in an expanded state and a cassette contracted position where the sheet cassette is in a contracted state, the tray expansion/contraction part comprising a rear end regulation member configured to be moved in a direction in which the recording media stacked in the sheet cassette are fed to regulate rear ends of the recording media and a sliding guide part configured to support the rear end regulation member to freely slide and to form a moving path of the rear end regulation member; and the sheet cassette further comprises an auxiliary member that is configured to be attached, when the tray expansion/contraction part is in the cassette expanded position, to the sliding guide part of the tray expansion/contraction part to extend a length of the moving path of the rear end regulation member of the tray expansion/contraction part between the tray expansion/contraction part and the tray main body part and is configured to be detached from the sliding guide part of the tray expansion/contraction part when the tray expansion/contraction part is in the cassette contracted position.

10. The sheet feeding device according to claim 9, wherein the sheet cassette comprising a fall-off prevention member provided to an end part of the sliding guide part of the tray expansion/contraction part at the side of the tray main body part and configured to prevent the rear end regulation member from falling off the sliding guide part.

11. The sheet feeding device according to claim 9, wherein the sheet cassette comprises a reinforcing member provided to a backside surface of the tray expansion/contraction part.

12. The sheet feeding device according to claim 9, wherein the auxiliary member is configured, when the sheet cassette is in the expanded state, to connect, at one side end thereof, with an end of the sliding guide part of the tray expansion/contraction part in the direction in which the recording media are fed and to contact the tray main body part at the other side end thereof.

13. The sheet feeding device according to claim 10, wherein the fall-off prevention member is disposed across the sliding guide part of the tray expansion/contraction part such that ends thereof engage the sliding guide part.

14. The sheet feeding device according to claim 11, wherein the reinforcing member extends across the sliding guide part of the tray expansion/contraction part and is integrated with the tray expansion/contraction part at both ends thereof in a direction in which the reinforcing member is extended and is configured to prevent the tray expansion/contraction part from extending in a direction orthogonal to a direction in which the tray expansion/contraction part slides.

15. The sheet feeding device according to claim 9, wherein the tray main body part comprises holding parts configured to hold the tray expansion/contraction part at the cassette expanded position and the cassette contracted position and an indication part configured to differentiate a state that the tray expansion/contraction part is held by the tray main body part from a state that the tray expansion/contraction part is released from being held by the tray main body part.

16. The sheet feeding device according to claim 15, wherein the tray expansion/contraction part comprises engaging members, and the holding parts of the tray main body part comprise locking parts configured to engage with and disengage from the engaging members of the tray expansion/contraction part, and the indication part is configured to differentiate a state that the tray expansion/contraction part is held by the tray main body part from a state that the tray expansion/contraction part is released from being held by the tray main body part according to engaging states of the engaging members of the tray expansion/contraction part and the locking parts of the tray main body part.

17. An image forming apparatus, comprising:

an image forming device configured to form an image on a photoconductor; and a sheet cassette configured to feed recording media to receive the image from the photo conductor, the sheet cassette comprising a tray main body part, and a tray expansion/contraction part supported by the tray main body part and configured to slide relative to the tray main body part to a cassette expanded position where the sheet cassette is in an expanded state and a cassette contracted position where the sheet cassette is in a contracted state, the tray expansion/contraction part comprising a rear end regulation member configured to be moved in a direction in which the recording media stacked in the sheet cassette are fed to regulate rear ends of the recording media and a sliding guide part configured to support the rear end regulation member to freely slide and to form a moving path of the rear end regulation member; and the sheet cassette further comprises an auxiliary member that is configured to be attached, when the tray expansion/contraction part is in the cassette expanded position, to the sliding guide part of the tray expansion/contraction part to extend a length of the moving path of the rear end regulation member of the tray expansion/contraction part between the tray expansion/contraction part and the tray main body part and is configured to be detached from the sliding guide part of the tray expansion/contraction part when the tray expansion/contraction part is in the cassette contracted position.

18. The image forming apparatus according to claim 17, wherein the sheet cassette comprises a fall-off prevention member provided to an end part of the sliding guide part of the tray expansion/contraction part at the side of the tray main body part and configured to prevent the rear end regulation member from falling off the sliding guide part.

19. The image forming apparatus according to claim 17, wherein the sheet cassette comprises a reinforcing member provided to a backside surface of the tray expansion/contraction part.

20. The image forming apparatus according to claim 17, wherein the auxiliary member is configured, when the sheet cassette is in the expanded state, to connect, at one side end thereof, with an end of the sliding guide part of the tray expansion/contraction part in the direction in which the recording media are fed and to contact the tray main body part at the other side end thereof.

21. The image forming apparatus according to claim 18, wherein the fall-off prevention member is disposed across the sliding guide part of the tray expansion/contraction part such that ends thereof engage the sliding guide part.

22. The image forming apparatus according to claim 19, wherein the reinforcing member extends across the sliding guide part of the tray expansion/contraction part and is integrated with the tray expansion/contraction part at both ends thereof in a direction in which the reinforcing member is extended and is configured to prevent tray expansion/contraction part from extending in a direction orthogonal to a direction in which the tray expansion/contraction part slides.

23. The image forming apparatus according to claim 17, wherein the tray main body part comprises holding parts configured to hold the tray expansion/contraction part at the cassette expanded position and the cassette contracted position and an indication part configured to differentiate a state that the tray expansion/contraction part is held by the tray main body part from a state that the tray expansion/contraction part is released from being held by the tray main body part.

24. The image forming apparatus according to claim 23, wherein the tray expansion/contraction part comprises engaging members, and the holding parts of the tray main body part comprise locking parts configured to engage with and disengage from the engaging members of the tray expansion/contraction part, and the indication part is configured to differentiate a state that the tray expansion/contraction part is held by the tray main body part from a state that the tray expansion/contraction part is released from being held by the tray main body part according to engaging states of the engaging members of the tray expansion/contraction part and the locking parts of the tray main body part.

25. The image forming apparatus according to claim 17, further comprising:

a plurality of openings below the image forming device and configured to receive a plurality of the sheet cassettes.

26. A sheet cassette comprising:

a tray main body part;

means for sliding relative to the tray main body part to a cassette expanded position where the sheet cassette is in an expanded state and a cassette contracted position where the sheet cassette is in a contracted state, the means comprising a rear end regulation member configured to be moved in a direction in which recording media stacked in the sheet cassette are fed to regulate rear ends of the recording media and a sliding guide part configured to support the rear end regulation member to freely slide and to form a moving path of the rear end regulation member; and auxiliary means configured to be attached, when the means for sliding is in a cassette expanded position, to the sliding guide part of the means for sliding to extend a length of the moving path of the rear end regulation member of the means for sliding between the means for sliding and the tray main body part and is configured to be detached from the sliding guide part of the means for sliding when the means for sliding is in a cassette contracted position.

27. A method of expanding and contracting a sheet cassette, comprising:

providing a tray main body part;

providing a tray expansion/contraction part supported by the tray main body part and configured to slide relative to the tray main body part to a cassette expanded position where the sheet cassette is in an expanded state and a cassette contracted position where the sheet cassette is in a contracted state, the tray expansion/contraction part comprising a rear end regulation member configured to be moved in a direction in which recording media stacked in the sheet cassette are fed to regulate rear ends of the recording media and a sliding guide part configured to support the rear end regulation member to freely slide and to form a moving path of the rear end regulation member; and providing an auxiliary member that is configured to be attached, when the tray expansion/contraction part is in the cassette expanded position, to the sliding guide part of the tray expansion/contraction part to extend a length of the moving path of the rear end regulation member of the tray expansion/contraction part between the tray expansion/contraction part and the tray main body part and is configured to be detached from the sliding guide part of the tray expansion/contraction part when the tray expansion/contraction part is in the cassette contracted position.

28. A sheet cassette comprising:

a tray main body part; and a tray expansion/contraction part supported by the tray main body part and configured to slide relative to the tray main body part to a cassette expanded position where the sheet cassette is in an expanded state and a cassette contracted position where the sheet cassette is in a contracted state, the tray expansion/contraction part comprising a rear end regulation member configured to be moved in a direction in which recording media stacked in the sheet cassette are fed to regulate rear ends of the recording media and a sliding guide part including an elongated slit and a plurality of rail members configured to support the rear end regulation member to freely slide and to form a moving path of the rear end regulation member, at least one of the rails including a rack configured to engage with the rear end regulation member.

* * * * *